United States Patent [19]

Strunc

[11] 4,123,649

[45] Oct. 31, 1978

[54] PRINT AND ORDER TOTALIZER FOR AUTOMATIC PHOTOGRAPHIC PAPER CUTTER

[75] Inventor: Gerald R. Strunc, Maple Grove, Minn.

[73] Assignee: Pako Corporation, Minneapolis, Minn.

[21] Appl. No.: 838,065

[22] Filed: Sep. 29, 1977

[51] Int. Cl.[2] ..... G06M 3/06; G07C 3/10

[52] U.S. Cl. ..... 235/92 PD; 235/92 SB; 235/92 CT; 235/92 R; 355/13; 355/29

[58] Field of Search ..... 235/92 PD, 92 CT, 92 SB; 355/13, 14, 29

[56] References Cited

U.S. PATENT DOCUMENTS

| | | | |
|---|---|---|---|
| 3,562,491 | 2/1971 | Branfield | 235/92 SB |
| 3,689,742 | 9/1972 | Kagari et al. | 235/92 PD |
| 3,718,807 | 2/1973 | Bracken et al. | 235/92 PD |
| 3,912,390 | 10/1975 | Van Herten | 355/14 |

*Primary Examiner*—Joseph M. Thesz

*Attorney, Agent, or Firm*—David R. Fairbairn; John W. Adams

[57] ABSTRACT

An automatic photographic paper cutter includes a print and order totalizer system which stores information such as the number of prints cut and the number of orders which have been processed by the paper cutter. In one operating mode, the totalizer system counts the number of prints cut in each order. At the end of an order, the number of prints cut in that order is displayed and is maintained on the display until the next order is completed. This allows the operator time to record the number of prints in the previous order while the next order is being cut. In another mode, the totalizer system displays the total number of prints cut and total number of orders since operation of the paper cutter commenced. This information is particularly useful to management since it permits an accurate determination of the performance of both the automatic paper cutter and the particular operator of the cutter.

4 Claims, 15 Drawing Figures

PRINT AND ORDER TOTALIZER FOR AUTOMATIC PHOTOGRAPHIC PAPER CUTTER

REFERENCE TO CO-PENDING APPLICATIONS

Reference is made to the following co-pending patent applications which are filed on even date with this application and are assigned to the same assignee as this application: "Microprocessor Controlled Photographic Paper Cutter" Ser. No. 838,064 by G. Strunc and F. Laciak; "Paper Drive Mechanism for Automatic Photographic Paper Cutter" Ser. No. 837,987 by R. Diesch; "Multichannel Indicia Sensor for Automatic Photographic Paper Cutter" Ser. No. 837,986 by R. Diesch and G. Strunc; "Stepper Motor Control" Ser. No. 837,988 by G. Strunc; "Paper Feed Control for Automatic Photographic Paper Cutter" Ser. No. 838,000 by R. Diesch G. Strunc; and "Photographic Paper Cutter with Automatic Paper Feed in the Event of Occasional Missing Cut Marks" Ser. No. 837,999 by G. Strunc; and "Knife Assembly for Photographic Strip Cutter" Ser. No. 837,998 by R. Diesch. Subject matter disclosed but not claimed in the present application is disclosed and claimed in these co-pending applications.

BACKGROUND OF THE INVENTION

The present invention relates to photographic processing equipment. In particular, the present invention relates to a totalizer system which stores and displays information related to the operation of an automatic photographic paper cutter, such as the number of prints cut in the previous order, and the total number of prints and orders cut during a day or during a shift.

In commercial photographic processing operations, very high rates of processing must be achieved and maintained in order to operate profitably. To expedite the photographic processing, orders containing film of similar type and size are spliced together for developing. As many as 500 to 1000 rolls of 12, 20, and 36 exposure film may be spliced together for processing and printing purposes.

After developing, the photographic images contained in the film negatives are printed in an edge-to-edge relationship on a continuous strip of photosensitive paper by a photographic printer. The photographic printer causes high intensity light to be passed through a negative and imaged on the photographic print paper. The photographic emulsion layer on the print paper is exposed and is subsequently processed to produce a print of the image contained in the negative.

After the strip of print paper has been photoprocessed to produce prints, a photographic paper cutter cuts individual prints from the strip. The prints are then sorted by customer order and ultimately packaged and sent to the customer.

Automatic print paper cutters have been developed which automatically cut the print paper into individual prints. These automatic paper cutters are controlled by indicia which are placed along the print paper by the photographic printer. Typically the indicia are of two types: cut marks and end-of-order marks. The cut marks indicate the desired location of a cut between adjacent prints. The end-of-order marks, which typically appear along the opposite edge of the print paper from the cut marks, indicate the end of a customer's order. The automatic paper cutter includes a sensor which senses the cut mark and causes the individual prints to be cut from the strip at the desired locations. The separated prints are passed to an order packaging or grouping device, which groups the prints in response to the end-of-order marks which are sensed by the automatic cutter.

The desire for high rates of processing within commercial photographic processing operations has led to the development of extremely high speed automatic paper cutters. Automatic paper cutters capable of cutting over 25,000 prints per hour (i.e. over 7 prints per second) have been desired and are being developed.

Despite the automatic operation of the automatic paper cutters, the amount of information supplied by the automatic paper cutter to the operator has been rather limited. Some automatic paper cutters have included a mechanical counter which counts the prints from each order as they are cut. At the end of an order, the counter is reset and begins to count again as the prints from the next order are cut.

In some cases, such as when the automatic paper cutter is not used in conjunction with an automatic print packaging system, the operator must record the number of prints cut in each order for billing purposes. This has, in the past, been primarily a manual operation, with the operator manually recording the information on the mechanical counter at the end of an order.

SUMMARY OF THE INVENTION

The present invention is a totalizer system for use with an automatic photographic paper cutter. The totalizer system stores and displays useful management information such as the number of prints cut in the preceding order, the total number of prints cut during that shift or during the day, and the total number of orders which have been processed.

The present invention utilizes, in its preferred embodiments, the information processing and storage capability of a microprocessor based electronic system. This preferably is the same microprocessor based system which is used to control the complete operation of the automatic photographic paper cutter.

The system of the present invention counts the number of prints cut in each order and the number of orders which are processed. In one operating mode, the system displays the number of prints cut in the previous order while the following order is being cut. This permits sufficient time for the operator to record this information if desired.

In another mode, the system displays the total number of prints and orders since commencement of operation. It is possible, therefore, to determine the number of prints which have been cut during a particular shift or since commencement of operation that day. This allows management to monitor and evaluate the performance of both the operator and the automatic photographic paper cutter.

DETAILED DESCRIPTION OF THE PREFERRED EMBODIMENTS

Introduction

The print and order totalizer system of the present invention stores and displays information regarding the operation of an automatic photographic paper cutter. In the preferred embodiments, the print and order totalizer system takes advantage of the storing and data processing capabilities of a microprocessor based electrical control system. This microprocessor based electrical control system may be a separate accessory to an automatic photographic paper cutter, or may be the control system which controls the entire operation of the automatic photographic paper cutter.

The print and order totalizer system of the present invention has been used to considerable advantage in an automatic photographic paper cutter which cuts photographic prints from a strip of photographic paper at rates as high as 25,000 prints per hour. This automatic photographic paper cutter is microprocessor controlled, and the print and order totalizer of the present invention makes use of the same microprocessor which is used to control the other functions of the automatic photographic paper cutter.

The following section, which is entitled "Paper Cutter System Overview," generally describes the operation of the high speed, microprocessor controlled, photographic paper cutter including the print and order totalizer system of the present invention. A more detailed description of the entire electrical control system of the automatic paper cutter may be found in the previously mentioned co-pending application entitled "Microprocessor Controlled Photographic Paper Cutter," and a more detailed description of the paper supply and drive mechanism may be found in the previously mentioned application entitled "Paper Drive Mechanism for Automatic Photographic Paper Cutter." The other co-pending patent applications referred to in the "Reference to Co-Pending Applications" also describe various aspects of the automatic photographic paper cutter shown in the Figures. For that reason, a detailed description of all of the various components of the automatic paper cutter will not be included in the present application. Instead, a discussion of the automatic paper cutter will concentrate on the print and order totalizer of the present invention, and will describe the operation of the automatic paper cutter in general terms, except where that operation is directly concerned with the present invention.

Paper Cutter System Overview

Figure 1:
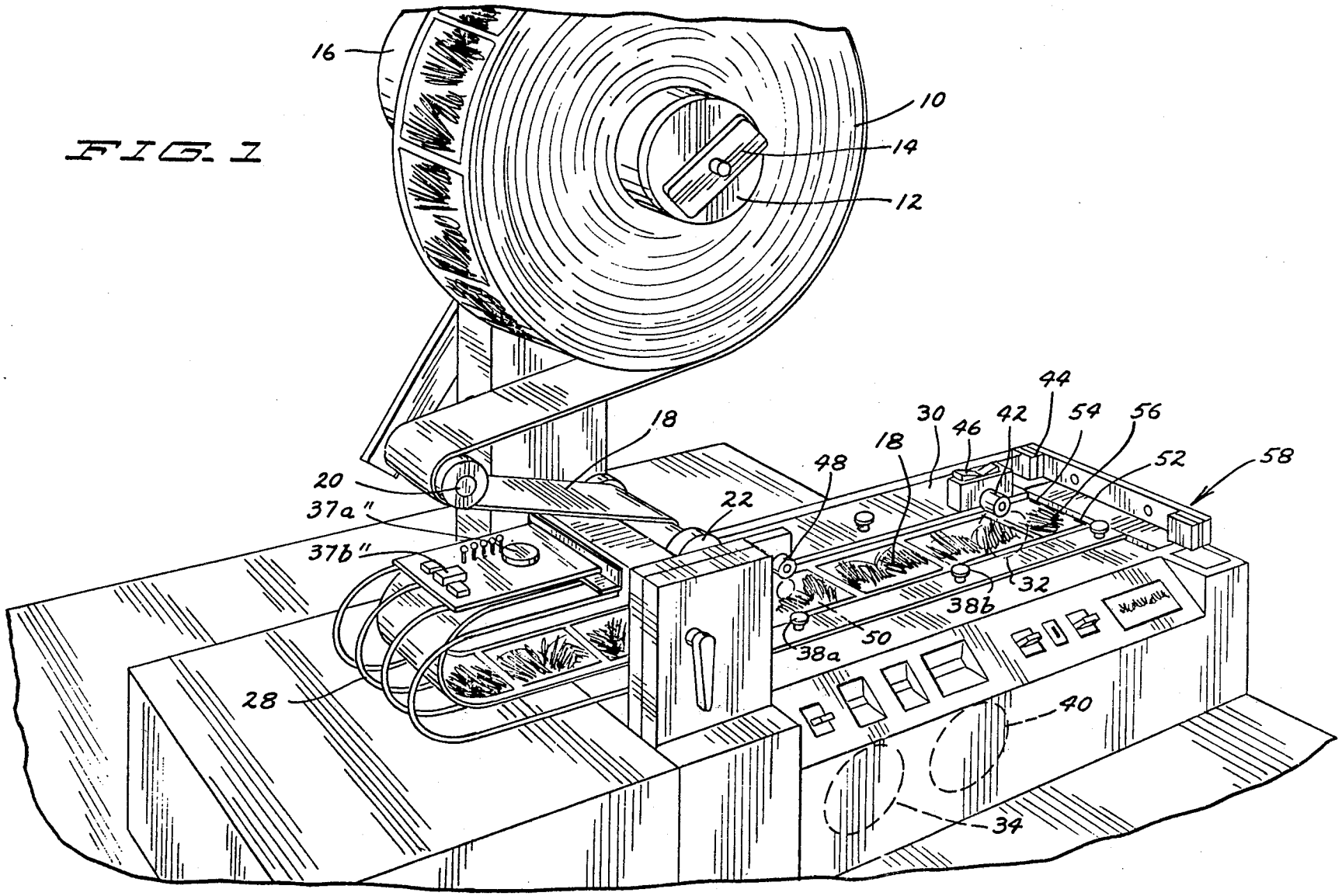
FIG. 1 is a perspective view of an automatic paper cutter utilizing the print and order totalizer of the present invention.

FIG. 1 is a perspective view of a high speed, microprocessor controlled, automatic paper cutter which includes the print and order totalizer system of the present invention. The paper cutter includes five major portions: a paper supply, a paper drive mechanism, a knife assembly, main and auxiliary control panels, and control electronics.

The paper supply is an integral part of the paper cutter. A paper roll 10 is loaded from the front on to hub 12, and a lever 14 is tightened to hold paper roll 10 in place. By tightening lever 14, an elastomer material is expanded to give a press fit on the inside diameter of the core of paper roll 10. The rotation of hub 12 is controlled by electro-mechanical brake 16.

Paper strip 18 from roll 10 is trained over bale arm assembly 20 and guide roller 22, between drive and idler pinch rollers (not shown) into wire form retainer 28, and then to paper guides 30 and 32 of the paper drive mechanism. The drive pinch roller is driven by the same AC motor 34 which drives the knife assembly of the paper cutter. The motor 34 drive is transmitted to the drive pinch roller through a belt drive and electro-mechanical clutch 36 (shown schematically in FIG. 4). When the proper loop is generated, clutch 36 is de-energized and brake 16 is energized to prevent paper from unspooling off roll 10.

The paper drive mechanism includes paper guides 30 and 32, which receive paper strip 18 from the paper supply assembly. Rear guide 30 is fixed and front guide 32 is movable so that various paper widths can be accommodated. Front paper guide 32 is adjusted by loosening thumbscrews **38*a* and 38*b* and moving front guide 32** to the desired position.

Paper strip 18 is driven by stepper motor 40 through idler and drive pinch rollers 42 and 44. Idler roller 42 has a lever 46 to locate idler roller 42 in the engaged position for operation and in the disengaged position for loading paper, shipping, and other non-operating modes. Rollers 42 and 44 are located at the rear edge of strip 18 so that the entire print is visible to the operator. Additional guidance of paper strip 18 is provided by another set of idler rollers 48 and 50, which are located near the end of the paper cutter.

Front and rear indicia sensor assemblies 52 and 54 are mounted below top plate 56 and sense all types of marks which appear on the back side of paper strip 18. Cut marks sensed by front or rear sensor assemblies 52 or 54 are used to indicate the location of a desired paper cut.

Knife assembly 58 includes a base, spring-wrap clutch mechanism 60 (shown schematically in FIG. 4), AC motor 34 (which also drives the drive pinch roller of the paper supply), a main drive shaft, two crank arm assemblies, two vertical drive shafts, and interchangeable blades. One blade is used for cutting straight-bordered and straight-borderless prints, and the other blade is used for cutting round-cornered borderless prints.

Figure 2:
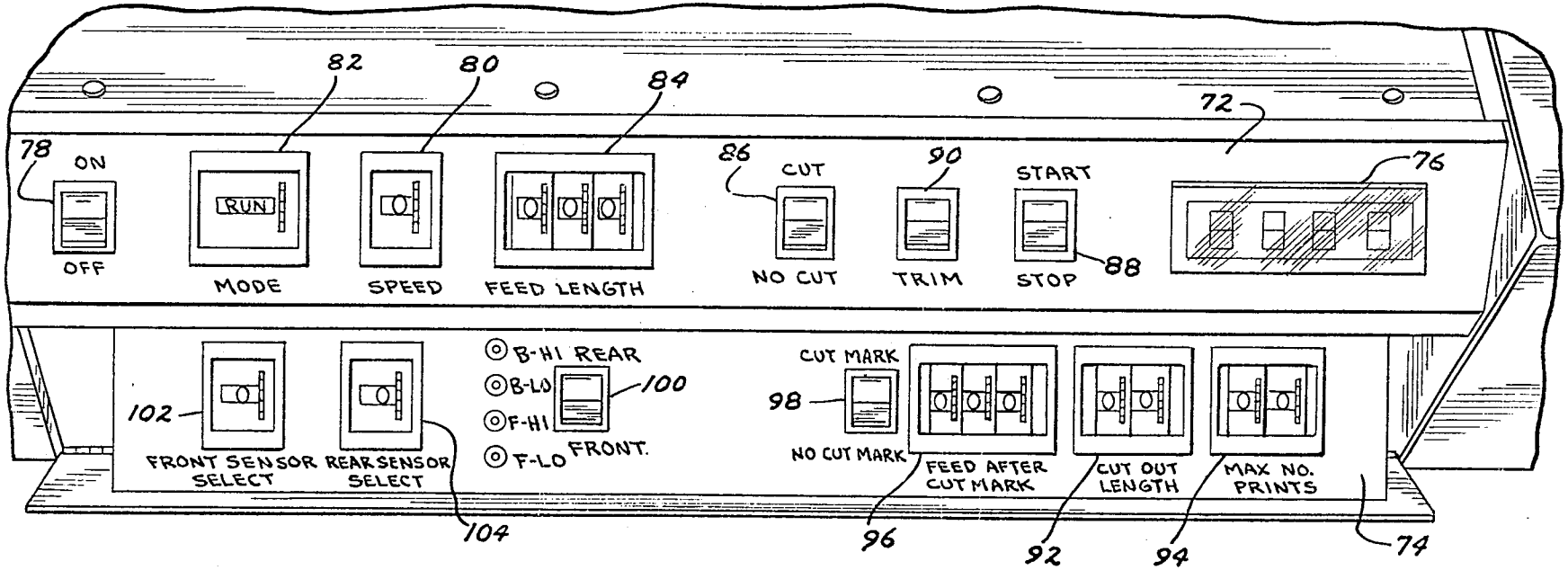
FIG. 2 shows the main and auxiliary control panels of the automatic paper cutter of FIG. 1.

FIG. 2 shows the main and auxiliary control panels 72 and 74. Main control panel 72, which is located at the front of the paper cutter, has a display 76 and seven switches. These seven switches are Power switch 78, Speed Select switch 80, Mode Select switch 82, Feed Length switch 84, Cut/No Cut switch 86, Start/Stop switch 88, and Trim switch 90.

The remaining seven switches of the automatic paper cutter are located on auxiliary panel 74, which is located below main control panel 72 and is accessible through a hinged cover. The seven switches are Length of Cutout switch 92, Maximum Number of Prints switch 94, Feed-After-Cut Mark switch 96, Cut Mark-/No Cut Mark switch 98, Front/Rear Cut Sensor switch 100, Front Sensor Select switch 102, and Rear Sensor Select switch 104.

The automatic paper cutter operation is commenced by turning on Power switch 78. Front paper guide 32 is then set to the appropriate paper width, paper roll 10 is installed on hub 12, and paper strip 18 is threaded through the paper supply and into the paper cutter.

The operator then selects the proper sensor assembly (either front sensor 52 or rear sensor 54) to sense cut marks by switching Front/Rear Cut Sensor switch 100 to the "Front" or the "Rear" position. The sensor assembly which is not selected is automatically used to sense end-of-order marks, which appear along the opposite edge of paper strip 18 from the cut marks.

The next step involves selecting a proper segment of the sensor assembly so that the largest sensor signal is provided. Mode switch 82 is placed in the SENSOR SELECT mode, and a portion of print paper strip 18 bearing a cut mark or end-of-order mark is oscillated back and forth past the sensor assembly. The operator sets the Front and Rear Sensor Select switches 102 and 104 to the settings which select the proper segments of sensor assemblies 52 and 54 so that the largest sensor signals are provided.

Mode switch 82 is then set to the FEED LENGTH CALIBRATE mode, Start switch 88 is actuated and one print is fed from cut mark to cut mark. The feed length is displayed on display 76 and that value is set into Feed Length switch 84 by the operator.

The operator then sets Mode switch 82 to the FEED-AFTER-SENSE mode. The edge of a print is aligned with a calibration mark on one of the paper guides 30 and 32. Start switch 88 is actuated and the paper advances to the next cut mark and stops. The feed-after-sense length is displayed on display 76, and the operator sets that value into Feed-After-Sense switch 96.

The operator then sets Mode switch 82 to the RUN mode and sets Speed switch 80 to the desired cycle rate. If bordered or round-cornered borderless prints are being cut, the paper cutter is then ready to operate. If straight borderless prints are being cut, the length of cutout must be set in Length of Cutout switch 92.

Automatic operation of the paper cutter can then be commenced by actuating Start switch 88. As each order is cut, the number of prints cut in that order is counted. If the automatic paper cutter is not used in conjunction with an automatic print packing device, at the end of the order the number of prints cut is displayed on display 76 and is maintained on display 76 while prints from the next order are being cut. This allows the operator sufficient time to record the displayed information if desired, even though the cutter continues to operate at high speed without interruption.

If, on the other hand, the automatic paper cutter is used in conjunction with an automatic print packing device, the number of prints in an order is incremented and displayed on display 76 as each print is cut. The operator does not have to record the number of prints in the order because the packer automatically performs this function.

At the end of a shift or the end of a day, summary modes are available by selecting the TOTAL mode of Mode switch 82. The total prints cut and the total orders cut during that shift or that day since power was turned on are displayed on display 76.

Print and Order Totalizer - Electrical System

Figure 3:
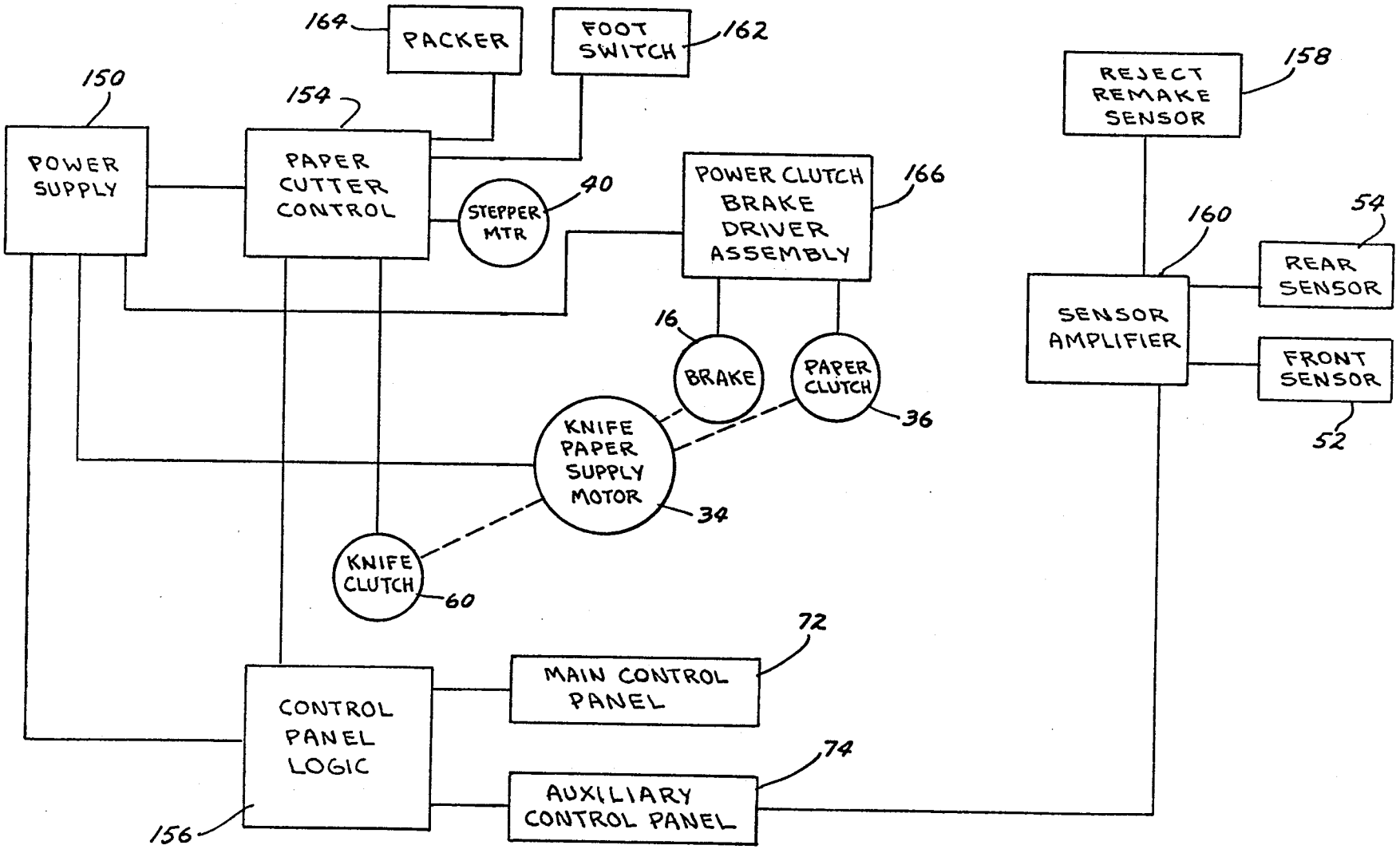
FIG. 3 is an electrical block diagram of the automatic paper cutter of FIG. 1.

FIG. 3 is an electrical block diagram of the automatic photographic paper cutter which includes the print and order totalizer system of the present invention. As shown in FIG. 3, power supply 150 supplies power to the various circuits and motors contained in the paper cutter. Power supply 150 is controlled by Power switch 78.

Paper cutter control 154 controls the operation of the paper cutter. Paper cutter control 154 receives inputs from the various switches of main control panel 72 and auxiliary panel 74 through control panel logic circuit 156. In addition, signals from reject/remake sensor 158, front indicia sensor 52 and rear indicia sensor 54 are processed by sensor amplifier circuit 160 and supplied through auxiliary panel 74 and control panel 156 to paper cutter control 154. Paper cutter control 154 may also receive inputs from optional foot switch 162 and optional automatic print packing device 164. Foot switch 162 is connected in parallel with the start contacts of start/stop switch 88 of main control panel 72 and allows the operator to initiate a feed-and-cut cycle without the use of hands. Packer 164 may be an automatic photographic print sorter and packer such as the PA-KOMP II photopacker manufactured by Pako Corporation. If the paper cutter is to be used in conjunction with packer 164, interconnection is necessary in order to coordinate the operation of the two devices.

The outputs of paper cutter control 154 control the operation of stepper motor 40. Control of AC motor 34 is achieved by means of knife clutch 60, paper clutch/-brake driver assembly 166, paper brake 16, and paper clutch 34. Paper cutter control 154 also supplies signals to control panel logic 156 which control display 76 on the main control panel 72, and supplies output signals to packer 164 if the paper cutter is being used in conjunction with packer 164.

Figure 4:
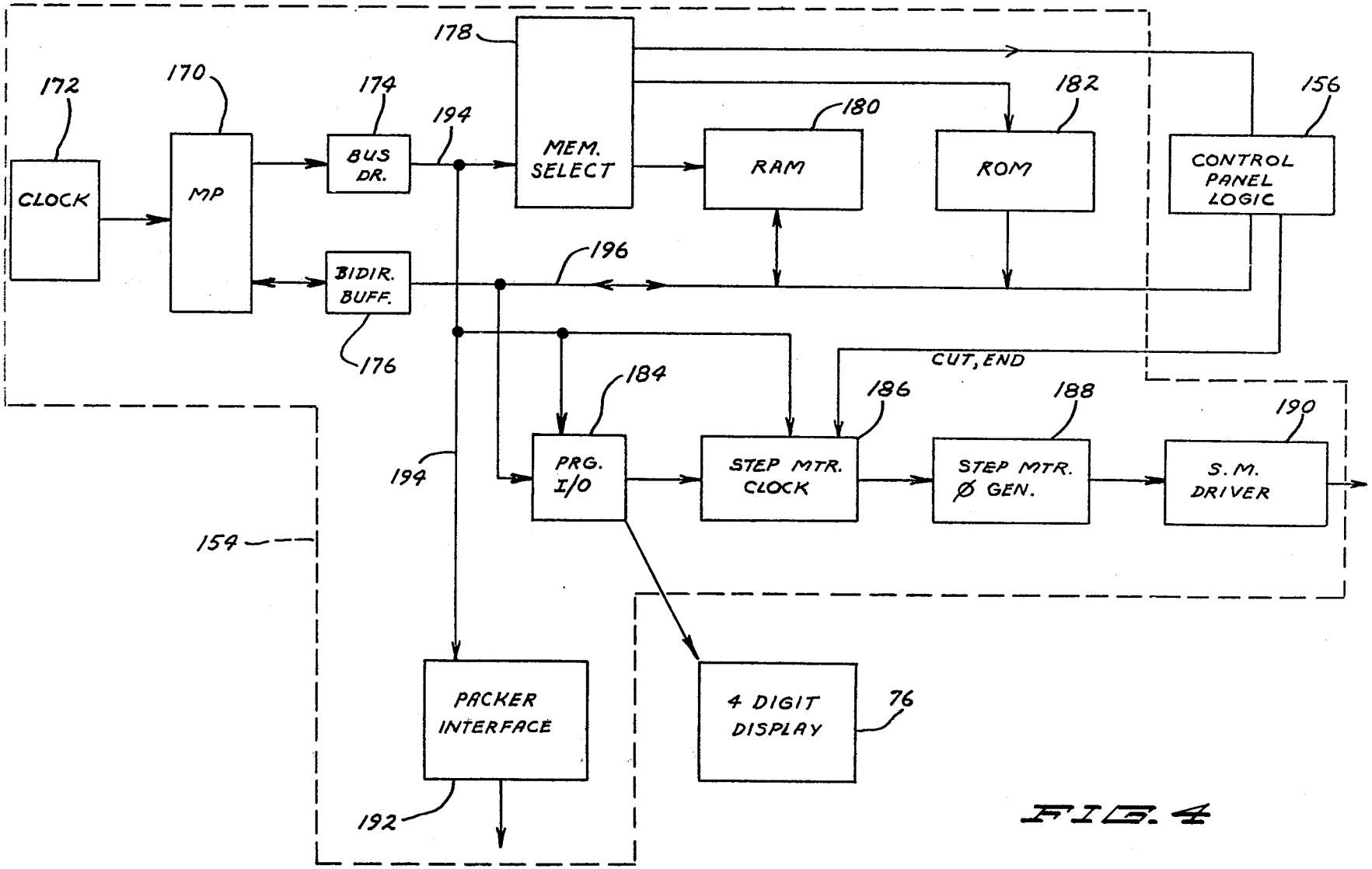
FIG. 4 is an electrical block diagram of the paper cutter control shown in FIG. 3.

FIG. 4 shows an electrical block diagram of paper cutter control 154. The paper cutter control includes microprocessor 170, clock 172, bus driver 174, bidirectional buffer 176, memory select circuit 178, random access memory (RAM) 180, read only memory (ROM) 182, programmable input/output (I/O) device 184, stepper motor clock 186, stepper motor phase generator 188, stepper motor driver 190, and packer interface circuit 192.

In one preferred embodiment, microprocessor 170 is an 8-bit microprocessor such as the Intel 8080A. Clock circuit 172 supplies clock signals, together with some other related signals, to microprocessor 170. Bus driver 174 receives outputs from microprocessor 170 and drives various lines of address bus 194. Memory select circuit 178 receives the signals from address bus 194 and addresses selected locations of RAM 180 or ROM 182. In addition, memory select circuit 178 may address the control panel logic 156 shown in FIG. 3 to interrogate the various switches of main and auxiliary control panels 72 and 74. In the system shown in FIG. 4, the switches of main and auxiliary panels 72 and 74 are addressed in the same manner as a memory location. Data to and from RAM 180 and data from ROM 182 and control panel logic 156 is supplied over data bus 196. Bidirectional buffer 176 interconnects microprocessr 170 with data bus 196.

Programmable I/O device 184 is also connected to data bus 196 and receives data from microprocessor 170. This data is used to control operation of stepper motor 40 through stepper motor clock 186, stepper motor phase generator 188, and stepper motor driver 190. In addition to the output signals from programmable I/O device 184, stepper motor clock 186 receives the CUT and END signals from control panel logic 156. These signals indicate that cut and end-of-order marks, respectively, have been sensed. Stepper motor clock 186 includes status circuits which are periodically interrogated by microprocessor 170 to determine whether cut or end-of-order marks have been sensed.

Programmable I/O device 184 also controls the operation of display 76. Depending upon the particular mode selected by mode switch 82 on main control panel 72, display 76 may display the feed length, the feed-after-sense length, the number of prints in the previous order, or the total number of prints and orders since the cutter was turned on.

As shown in FIG. 4, packer interface circuit 192 is also connected to address bus 194. Packer interface circuit 192 supplies the necessary signals to packer 164 of FIG. 3 to coordinate the operation of packer 164 with the operation of the automatic paper cutter.

Figure 5:
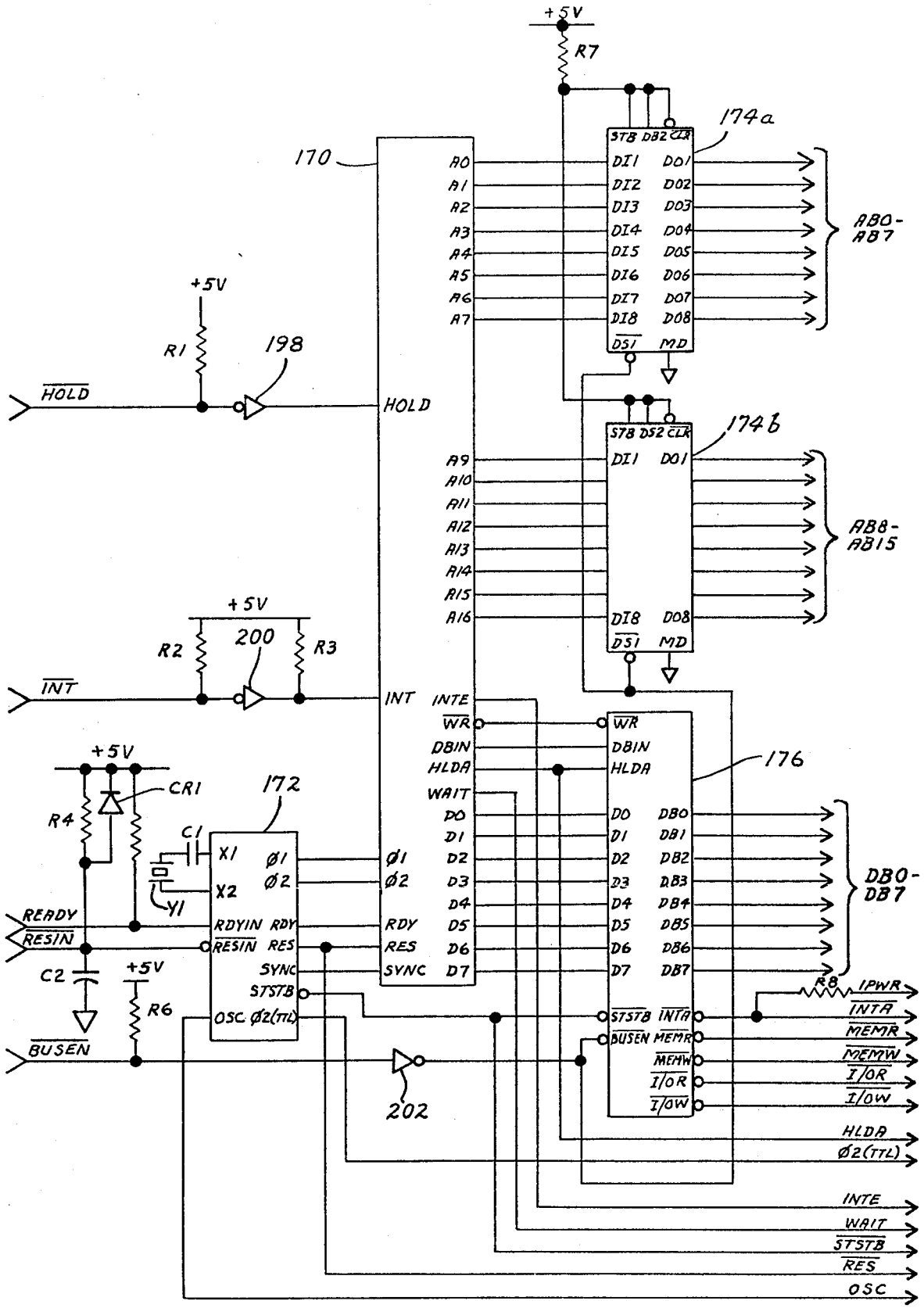
FIG. 5 is an electrical schematic diagram of a portion of the paper cutter control of FIG. 4 including a microprocessor, a clock, bus drivers, and a bidirectional buffer.

FIG. 5 shows a portion of cutter control 154 including microprocessor 170, clock 172, bus drivers 174*a* and 174*b*, and bidirectional buffer 176. Also included in the circuit of FIG. 5 are resistors R1–R8; capacitors C1 and C2; diode CR1; and inverters 198, 200, 202, and 204.

Clock 172, which is in one preferred embodiment an Intel 8224 integrated circuit, provides the 01 and 02 clock signals to microprocessor 170. The frequency of the 01 and 02 clock signals is determined by oscillator crystal Y1 and capacitor C1. In one preferred embodiment, crystal Y1 is selected to provide an 18.432 MHz oscillation.

In addition to the 01 and 02 clock signals, clock generator 172 also provides the RDY, $\overline{\text{RES}}$, and SYNC signals to microprocessor 170, the $\overline{\text{STSTB}}$ signal to bidirectional buffer 176, and the 02 (TTL) and OSC signals to other circuits within cutter control 154.

In addition to the signals supplied by clock 172, microprocessor 170 receives the HOLD signal from inverter 198 and the interrupt (INT) signal from inverter 200. The outputs of microprocessor 170 include address lines A0–A15, which are supplied to bus drivers 174*a* and 174*b*. The outputs of bus drivers 174*a* and 174*b* are address bus lines AB0–AB15, which form a 16-line address bus 194. Bus drivers 174*a* and 174*b* are enabled by the BUSEN signal from inverter 202.

Microprocessor 170 includes input/output ports D0–D7 for receiving and supplying data. D0–D7 are connected to bidirectional buffer 176, which also receives the WR, DBIN, and HLDA signals from microprocessor 170, the STSTB signal from clock 172, and the BUSEN signal from inverter 202.

Data lines DB0–DB7 of data bus 196 are connected to bidirectional buffer 176, which permits bidirectional flow of data on data bus 196 to and from microprocessor 170. In addition, bidirectional buffer 176 generates the $\overline{\text{INTA}}$, IPWR, $\overline{\text{MEMR}}$, $\overline{\text{MEMW}}$, $\overline{\text{I/OR}}$, and $\overline{\text{I/OW}}$ signals which determine the direction of flow of data on data bus 196 and control the operation of the various circuits connected to data bus 196.

The remaining signals generated by the circuit shown in FIG. 5 are generated by microprocessor 170. These signals are the HLDA, INTE, and WAIT signals.

Figure 6:
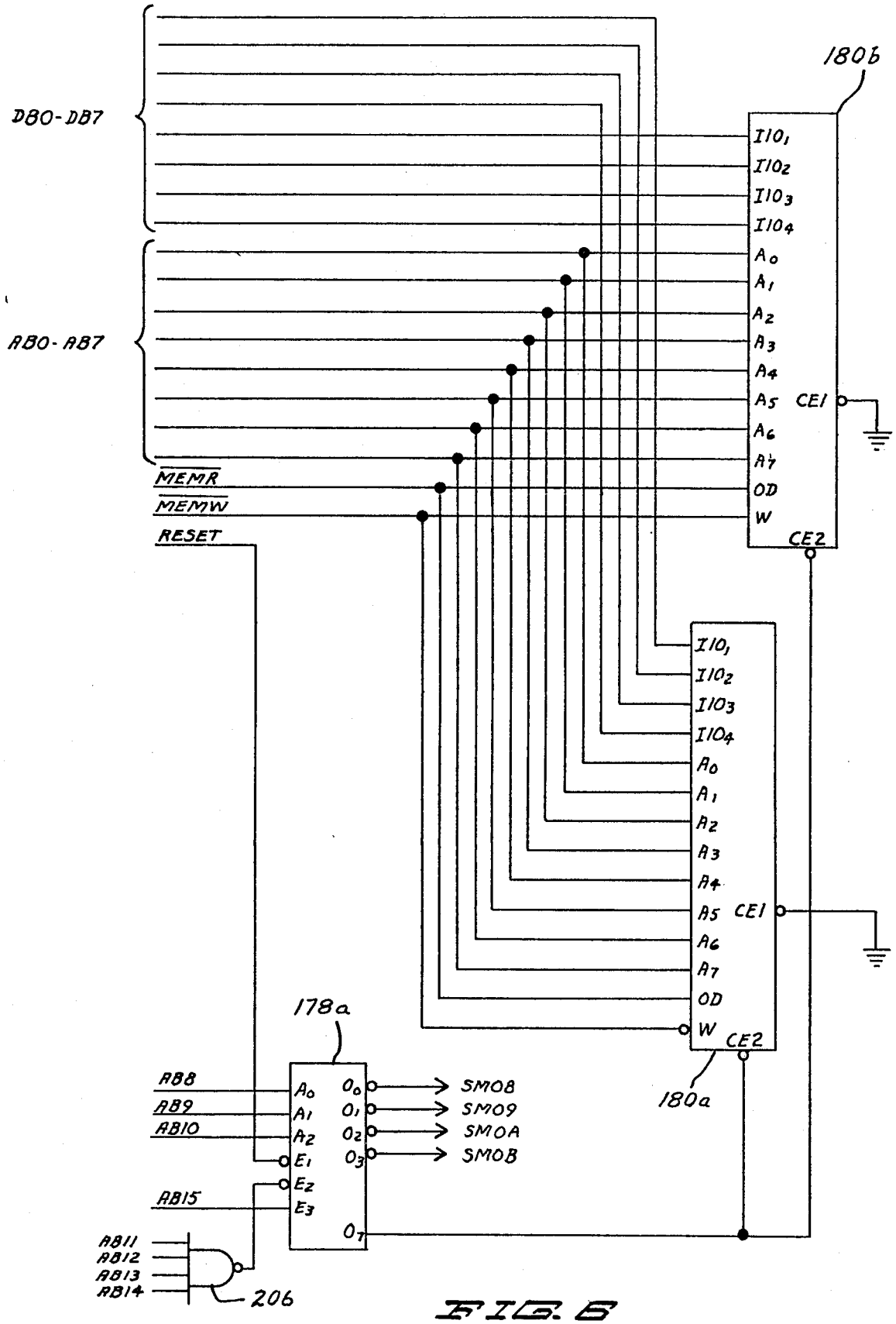
FIG. 6 is an electrical schematic diagram of a portion of the paper cutter control of FIG. 4 including random access memories and associated memory select circuitry.

FIG. 6 shows random access memories 180*a* and 180*b*, together with NAND gate 206 and memory select circuit 178*a*. In a preferred embodiment, random access memories 180*a* and 180*b* are Intel 8111-1 integrated circuits and memory select 178*a* is an Intel 8205 integrated circuit.

Depending upon the states of address bus lines AB8–AB15, memory select 178*a* provides an enable signal to either RAM 180*a* or 180*b*, or will generate an enable signal on lines SMO8, SMO9, SMOA or SMOB.

If either RAM 180*a* or RAM 180*b* is selected, data will either be written into or read from memory locations of the RAM. The state of the MEMW signal, which is supplied to the W inputs of RAMs 180*a* and 180*b* determines whether data is written or read.

As shown in FIG. 6, the random access memory includes only two RAM inegrated circuits 180*a* and 180*b*. If further storage is required, as many as six additional RAM integrated circuits may be connected and addressed by memory select 178*a*. In the embodiment of the automatic paper cutter described in the present application, however, two RAM integrated circuits is sufficient to provide the necessary storage.

Figure 7:
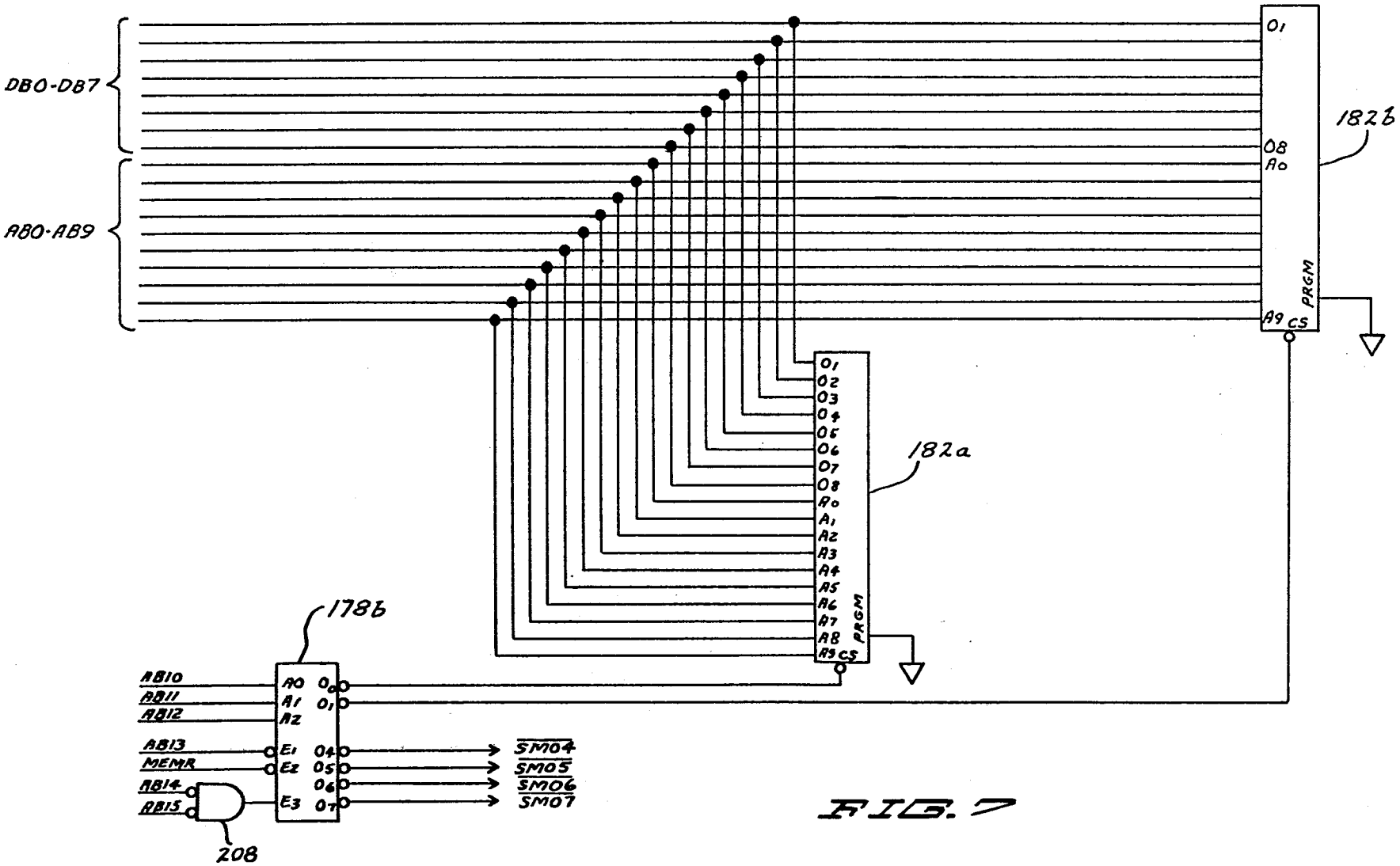
FIG. 7 is an electrical schematic diagram of a portion of the paper cutter control including read-only memories and associated memory select circuitry.

FIG. 7 shows ROMs 182*a* and 182*b*, memory select circuit 178*b*, and NAND gate 208. Memory select circuit 178*b* enables either ROM 182*a* or 182*b* depending upon the state of address bus lines AB10–AB15 and the $\overline{\text{MEMR}}$ signal. In addition, memory select circuit 178*b* produces the $\overline{\text{SMO4}}$ — $\overline{\text{SMO7}}$ signals.

In a preferred embodiment, ROMs 182*a* and 182*b* are erasable programmable read only memories (EPROM) such as the Intel 8708. When either ROM 182*a* or 182*b* is enabled, address bus lines AB0–AB9 select the particular memory location, and data read from that location is supplied on data bus lines DB0–DB7.

As in the case of the random access memory shown in FIG. 6, the read only memory of FIG. 7 may include additional memory circuits if additional storage is required. With the configuration shown in FIG. 7, two additional Intel 8708 EPROMs may be added without requiring additional memory select circuitry.

Figure 8:
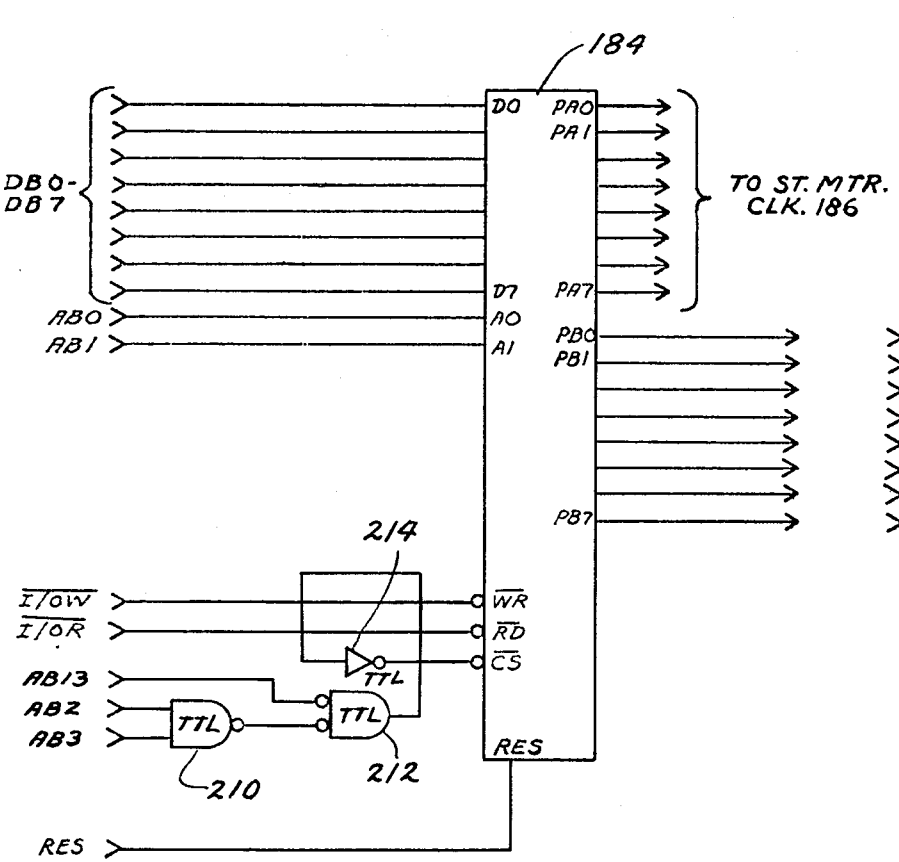
FIG. 8 is an electrical schematic diagram of the programmable input/output (I/O) device shown in FIG. 4.

FIG. 8 shows programmable I/O device 184 together with NAND gates 210 and 212 and inverter 214. In a preferred embodiment, programmable I/O device 184 is an Intel 8255 integrated circuit and NAND gates 210 and 212 and inverter 214 are TTL logic gates. Except where otherwise specifically indicated, all logic gates shown in the Figures are CMOS integrated circuit devices.

Programmable I/O device 184 receives data bus lines DB0–DB7, address bus lines AB0 and AB1, and the $\overline{\text{I/OW}}$, $\overline{\text{I/OR}}$ and RES lines. In addition, address bus lines AB2 and AB3 are NANDed by NAND gate 210, whose output is NANDed with address bus line AB13 by NAND gate 212. The output of NAND gate 212 is inverted by inverter 214 and supplied to the $\overline{\text{CS}}$ input of programmable I/O device 184.

Programmable I/O device 184 has two 8-line outputs. The first set of 8 outputs, which are designated PA0–PA7, are supplied to the inputs of stepper motor clock generator 186. The 8-bit number supplied on lines PA0–PA7 is used to control the frequency of the output of the stepper motor clock generator 186 and, therefore, the speed of stepper motor 40.

The PB0–PB7 outputs from programmable I/O device 184 are supplied to the main control panel 72. Lines PB0–PB7 are decoded and are used to drive display 76.

Figure 9:
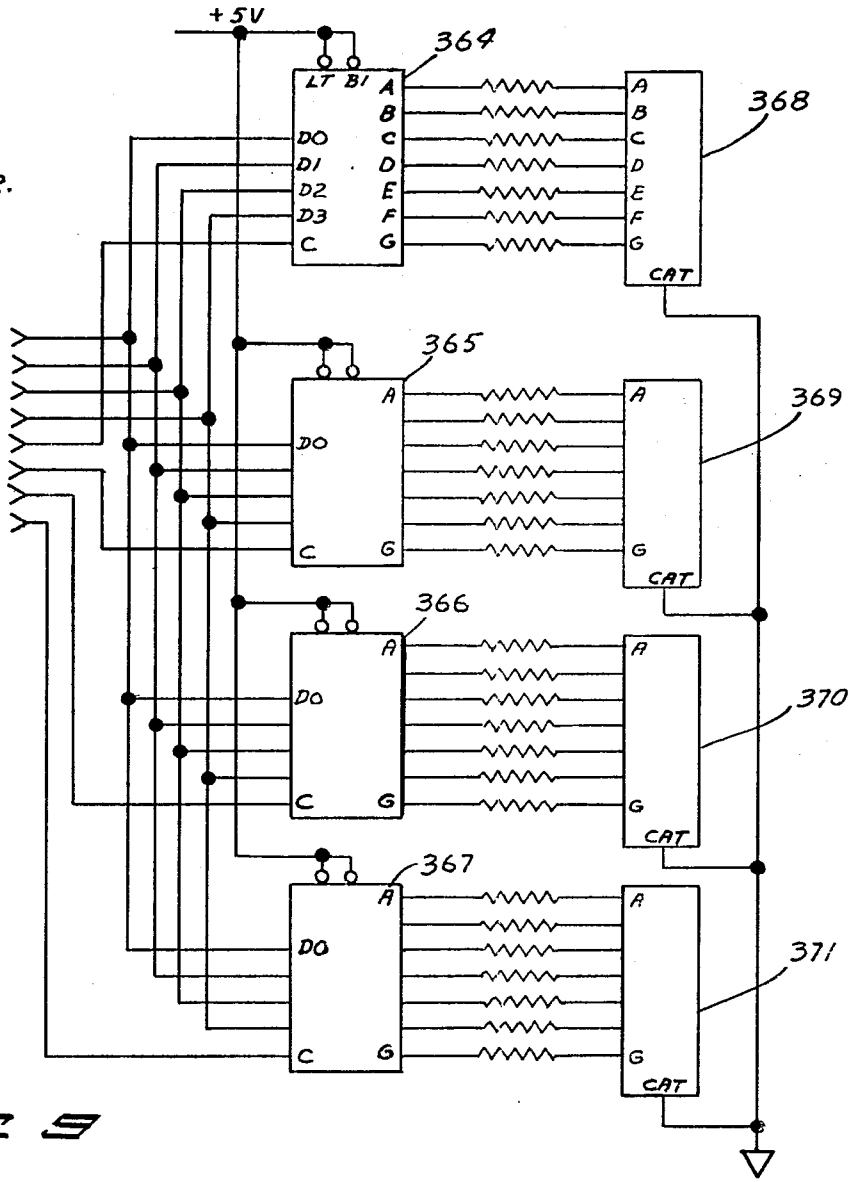
FIG. 9 is an electrical schematic diagram of the display.

FIG. 9 shows the circuitry associated with four digit display 76. The circuitry includes four seven-segment decoder driver latches 364–367 and four seven-segment LED displays 368–371. Display 368 represents the most significant digit and display 371 represents the least significant digit. Decoder driver latches 364–367 receive the PB0–PB7 signals from programmable I/O device 184 and drive displays 368–371 in accordance with those signals.

Print and Order Totalizer — Operation

The print and order totalizer system of the present invention includes stepper motor control 154 and display 76. In the system shown in the preceding Figures, display 76 displays a variety of information depending upon the particular mode selected by mode switch 82. When either the RUN mode or the TOTAL mode is selected, display 76 functions as a part of the print and order totalizer system of the present invention.

When the RUN mode is selected, the print and order totalizer system of the present invention causes the display 76 to display the number of prints cut in a particular order. If the automatic paper cutter is being used in conjunction with an automatic print packing device (i.e. packer 164 is connected), the print count displayed is incremented as each print is cut. If, on the other hand, the automatic paper cutter is not being used in conjunction with an automatic print packing device, display 76 displays the number of prints cut in an order, and holds that number while the next order is being cut. This provides the operator with sufficient time to record the number of prints in the previous order.

If the cutter is stopped in the middle of an order, the number of prints in the order cut up to that time is displayed. Paper cutter control 154 then returns to scanning the states of the switches on main and auxiliary control panels 72 and 74 to determine whether any of the switch settings have been changed and whether the operator has initiated another paper feed-and-cut cycle.

When the TOTAL mode is selected, display 76 displays the number of prints cut and orders completed since power was turned on. Because display 76 contains only four digits, and the number of prints or orders cut may exceed 10,000, the two most significant digits of the print count are first displayed, followed by the four least significant digits. Next, the two most significant digits of the order count are displayed, followed by the four least significant digits. This sequence continues as long as the TOTAL mode is selected. If a display having a larger number of digits is used, the sequence in the TOTAL mode may, of course, be changed.

FIGS. 10–13C and Table 1 illustrate the operation of the print and order totalizer system of the present invention. FIGS. 10—13C are flow charts which illustrate the operation of microprocessor 170 as it relates to the print and order totalizer of the present invention. Complete assembler listings for microprocessor 170 are shown in Table 1.

It should be noted that the flow charts shown in FIGS. 10—13C represent only those portions of the operation of microprocessor 170 which are directly related to the print and order totalizer of the present invention. It is clear from the preceding discussion that microprocessor 170 controls other functions of the automatic photographic paper cutter as well. Since these functions are not directly related to the present invention, they have not been shown in flow charts, although they are included in the assembler listings shown in Table 1. For a more complete description of the operation of microprocessor 170 in the automatic photographic paper cutter, reference should be made to the previously mentioned co-pending application entitled "Microprocessor Controlled Photographic Paper Cutter."

Figure 10:
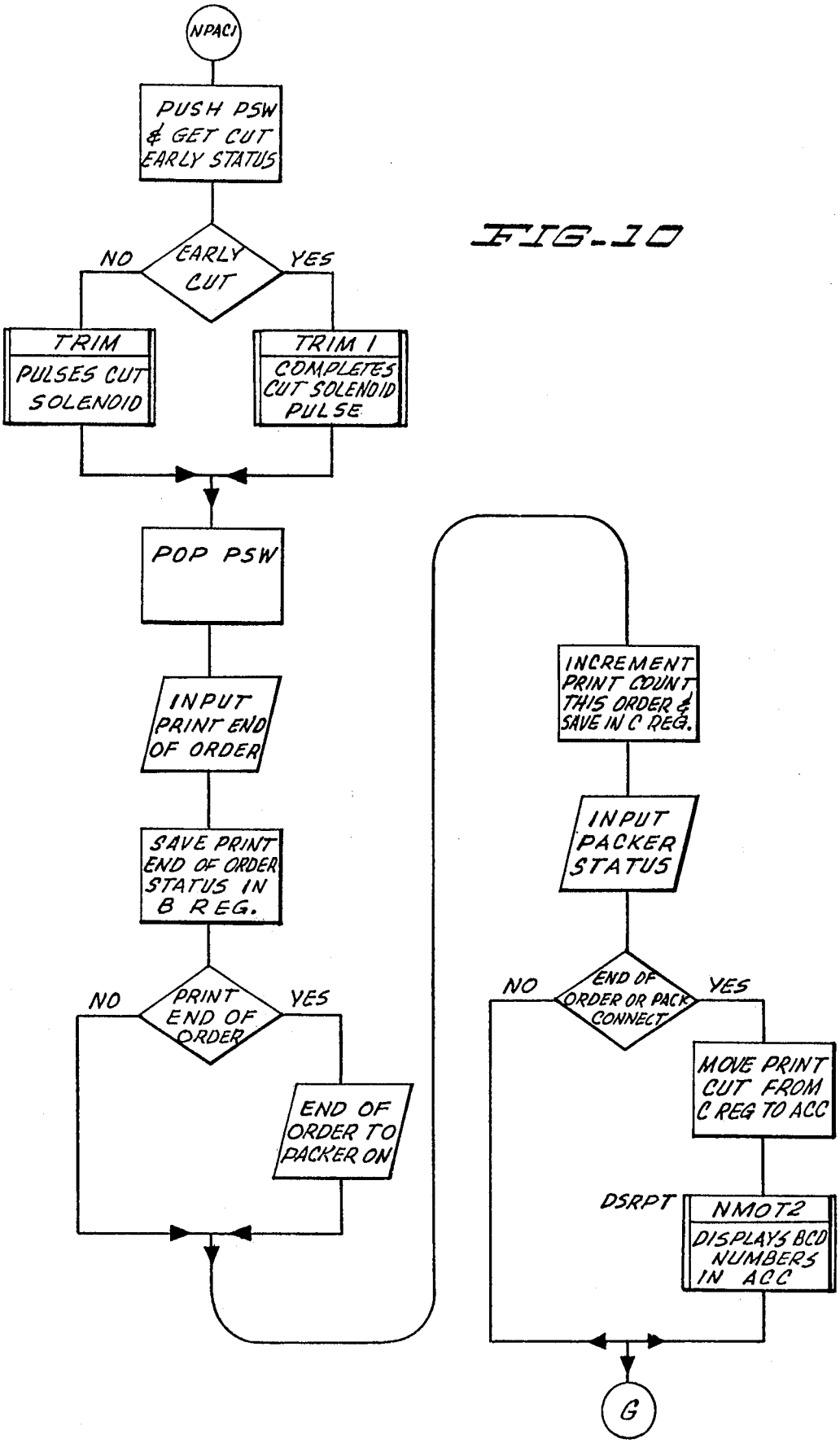
FIGS. 10-13C are flow charts illustrating the operation of the present invention.

FIG. 10 shows a portion of the ENDP routine. This routine, which is shown in greater detail in Table 1, performs the necessary functions at the end of a print. These functions include the stopping of the paper drive and the enabling of the knife assembly, so that a print is cut from the strip of photographic print paper. The portion of the ENDP routine shown in FIG. 10 deals specifically with the displaying of the number of prints cut in a particular order.

As shown in FIG. 10, the print count for each order is incremented and saved in the C register each time ENDP routine is performed. If packer 164 is connected, the print count is moved from the C register to the accumulator, and displayed on display 76. Similarly, if packer 164 is not connected, but the end of an order has been sensed, the print count is moved from the C register to the accumulator and displayed on display 76.

The effect of this routine is that the print count in an order will be displayed each time a print is cut if an automatic print packing or sorting device is used in conjunction with the automatic print cutter. If, on the other hand, the automatic paper cutter is being used without an automatic packer, display 76 only displays the print count at the end of an order and holds that print count throughout the next order until that order is completed. This allows the operator sufficient time to record the number of prints in the previous order. Since this information is necessary only when the cutter is being used without an automatic packing or sorting device, maintaining the previous print count throughout the next order is only performed when no automatic packing or sorting device is connected to the automatic paper cutter.

Figure 11:
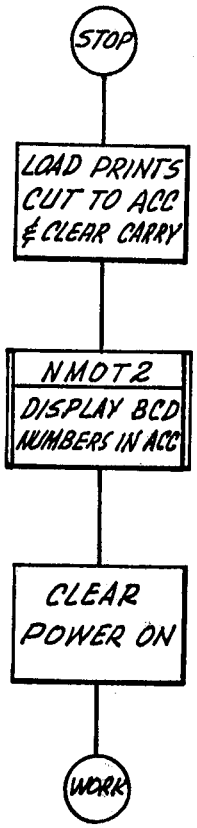

FIG. 11 shows the STOP routine, which occurs if the paper cutter is stopped in the middle of an order. This may occur due to some malfunction in the system or because the operator depresses the stop switch. In the STOP routine the number of prints cut this far in the order is loaded in the accumulator and displayed. The "power on" status is cleared and the microprocessor 170 returns to the WORK routine (not shown) in which the various switches on main and auxiliary control panels 72 and 74 are interrogated to determine whether any change in switch settings has been made and to determine whether the operator has initiated another print and cut cycle by depressing the start switch.

The TOTAL routine displays the totals of prints cut and orders completed since power was turned on. In the embodiment shown in FIG. 12, the two most significant digits of prints cut is first displayed, followed by the four least significant digits of prints cut. Then, the two most significant digits of orders completed are displayed, followed by the four least significant digits. This sequence is repeated, as long as the TOTAL mode is selected by the mode select switch 82.

In the TOTAL mode, therefore, the total number of prints cut and the total number of orders completed is counted, stored, and then displayed. The information provided by the TOTAL mode is particularly useful to management, since it permits an accurate determination of the performance of both the automatic paper cutter and the particular operator assigned to that paper cutter. As long as power remains on continuously, the print and order totalizer system continues to count the total number of prints and orders. It is possible, therefore, to determine the total number of prints and orders processed for each shift, or for each day, depending upon whether the power to the automatic paper cutter is turned off between shifts.

Figure 13C:
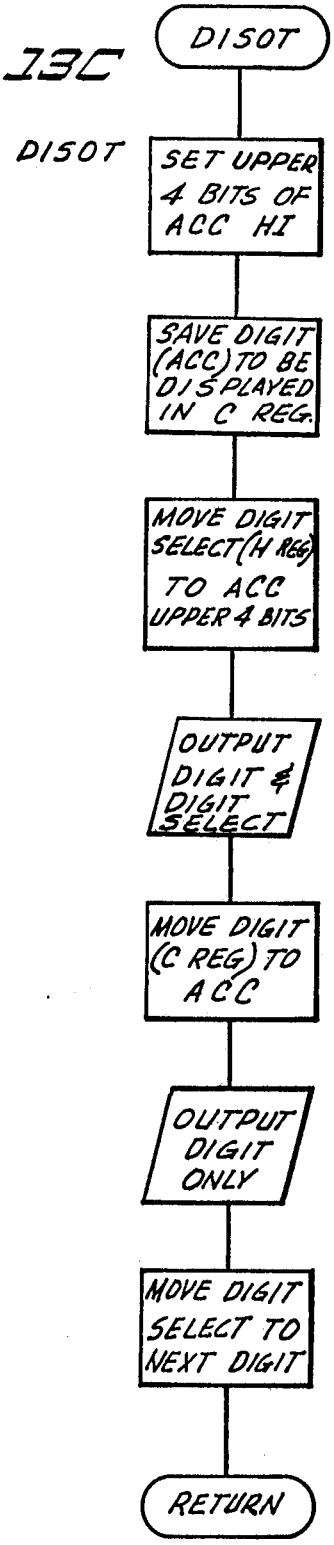
Figure 12:
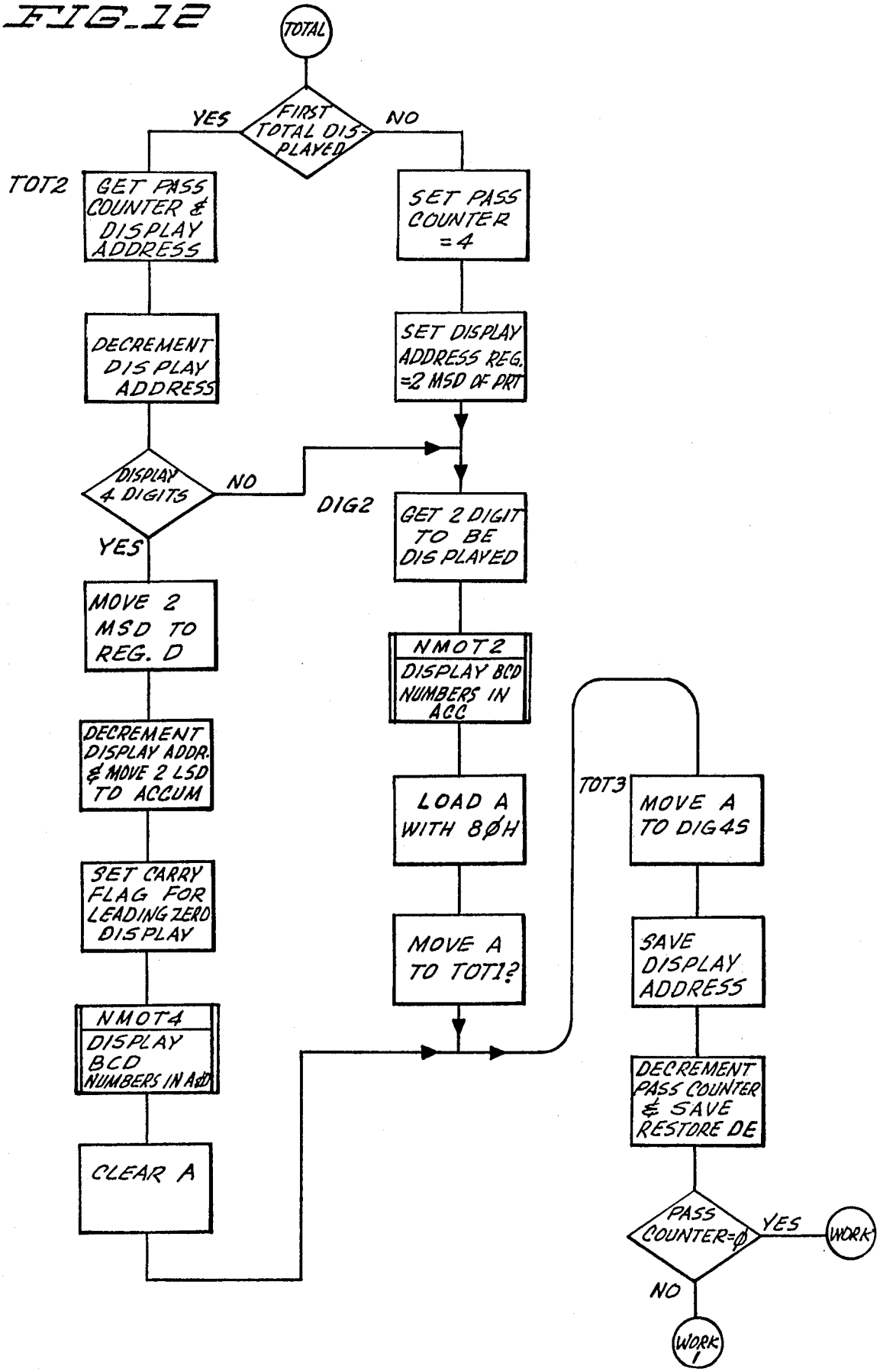
Figure 13A:
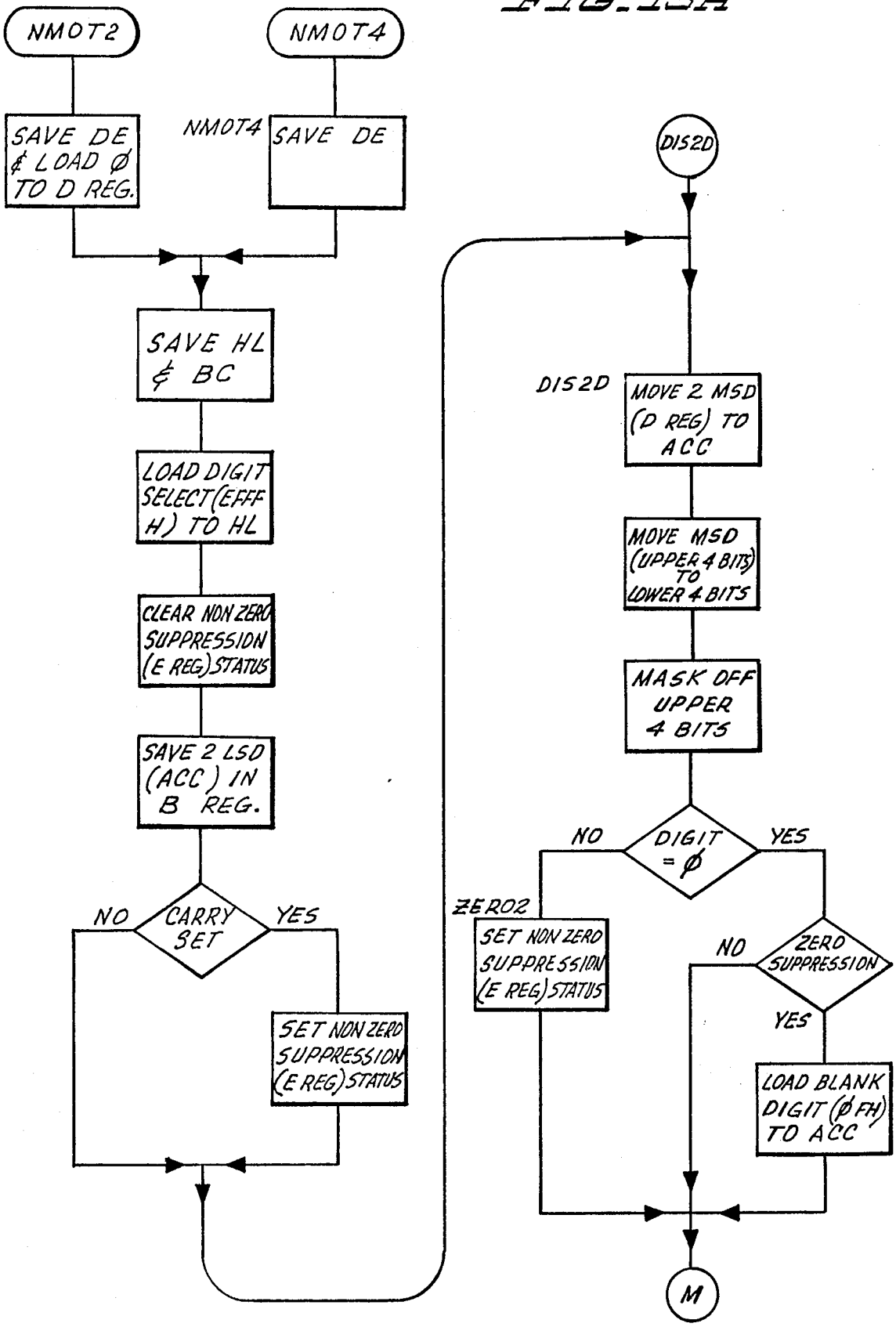
Figure 13B:
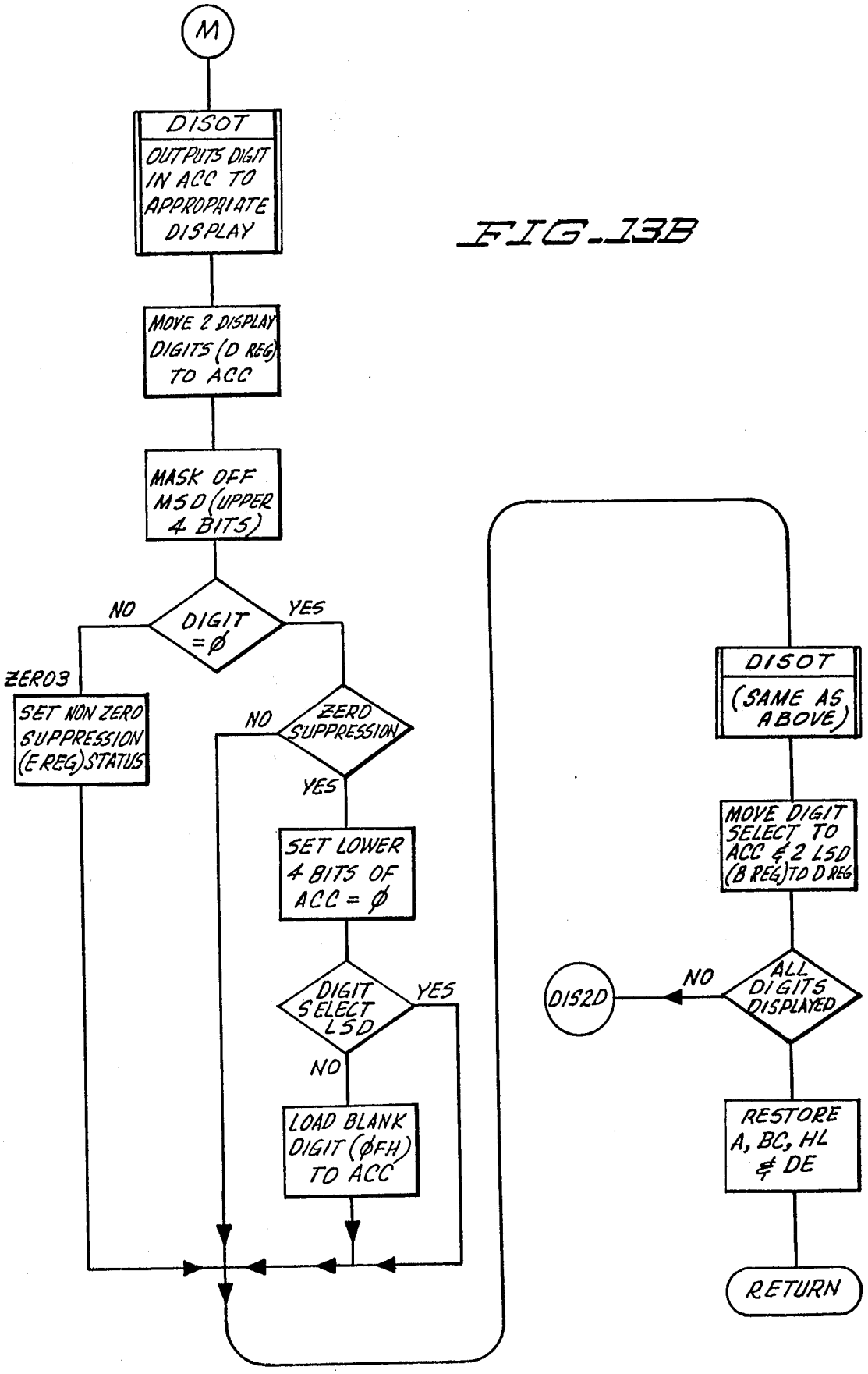

FIGS. 13A–13C illustrate the DISP routine. This routine allows either two or four digits to be displayed on digital display 76. The DISP routine is used in conjunction with the ENDP, STOP and TOTAL routines.

Conclusion

The print and order totalizer system of the present invention provides highly useful information regarding the operation of an automatic photographic paper cutter. The system counts and displays the number of prints in each order, and when the paper cutter is not being used in conjunction with an automatic packer, holds the number of prints cut in an order on the display until the next order is completed. This allows the operator time to record the number of prints in the previous order while the next order is being cut.

In addition, the print and order totalizer system displays the number of prints cut in a particular order if the paper cutter is stopped in the middle of an order. The operator may wish to record this information before restarting the automatic paper cutter.

Finally, the print and order totalizer counts and stores the number of prints cut and orders completed since the commencement of operation of the automatic paper cutter. When the TOTAL mode is selected, the total number of prints cut and the total number of orders completed is displayed.

Although the present invention has been described with reference to preferred embodiments, workers skilled in the art will recognize that changes may be made in form and detail without departing from the spirit and scope of the invention. For example, although the present invention has been described as a subsystem of an automatic photographic paper cutter, it may also be embodied as a subsystem of or an accessory to other photographic paper cutters.

TABLE 1

```
;ROUTINE:EQU
;
;EQUATES FOR 451 PAPER CUTTER
;
;MEMORY INPUT PORTS
;
PAFD1   EQU     1000H   ;2 LSD OF PAPER FEED LENGTH
PAFD2   EQU     1001H   ;MSD OF PAPER FEED LENGTH
CTFD1   EQU     1002H   ;2 LSD OF FEED AFTER CUT MARK
CTFD2   EQU     1003H   ;MSD OF FEED AFTER CUT MARK
CTOUT   EQU     1004H   ;2 DIGITS,CUT OUT BETWEEN PRINTS
SPDSL   EQU     1005H   ;LSD-SELECTS MAX SPEED OF MTR
                        ;MSD-4 SWITCHES ON SENSOR AMP
MAPRS   EQU     1006H   ;MAX NUMBER OF PRINTS PER ORDER
IDVSW   EQU     1007H   ;INDIVIDUAL SWITCHES:
                        ;0-NO CUT MARK,1-TRIM,2-START,
                        ;4-7-MODE SELECTION
;
;ISOLATED INPUT PORTS
;
COREC   EQU     0DFH    ;MACHINE KNIFE TO PRINT
                        ;EDGE CORRECTION SWITCH
;
;BITS 0-6 OF THE FOLLOWING INPUT PORTS ARE LOW AND
; CONTAIN NO DATA.
;
STEPC   EQU     0F0H    ;BIT 7 HI FOR STEP COMPETE
CTSIG   EQU     0F1H    ;BIT 7 HI FOR CUT MARK
PREOC   EQU     0F2H    ;BIT 7 HI FOR PRINT END OF ORDER
PACK    EQU     0F3H    ;BIT 7 LO FOR PACKER CONNECTED
KNIFE   EQU     0F4H    ;BIT 7 LO FOR PACKER KNIFE ENABLE
CTCP    EQU     0F5H    ;BIT 7 LO FOR CUT COMPLETE
RJECT   EQU     0F6H    ;BIT 7 HI FOR REJECT THIS PRINT
RMAKE   EQU     0F7H    ;BIT 7 HI FOR REMAKE THIS PRINT
;
;ISOLATED OUTPUT PORTS
;
;PORT ADDRESSES BEGINNING WITH B AND E DO NOT USE
;INFORMATION ON THE DATA BUS.
;THE MOST SIGNIFICANT HEXADECIMAL DIGIT OF THE PORT
;ADDRESS SELECTS AN ADDRESSABLE LATCH AND BITS 0-2 SELECTS
;A SINGLE BIT IN THE LATCH. THE STATE OF THE SELECTED BIT
;IS DETERMINED BY BIT 3 OF THE PORT ADDRESS.
;
RCKOF   EQU     0B0H    ;RESET STEP COMPLETE F/F OFF
REOOF   EQU     0B1H    ;RESET END OF ORDER F/F OFF
```

```
RCSOF   EQU     0B2H    ;RESET CUT SIGNAL F/F OFF
SMCCW   EQU     0B3H    ;STEP MTR CCW(REVERSE)
SMSTP   EQU     0B4H    ;STEPPER MOTOR STOP
RRCOF   EQU     0B5H    ;RESET REMAKE/REJECT COUNTER OFF
RCKON   EQU     0B8H    ;RESET STEP COMPLETE F/F ON
REOON   EQU     0B9H    ;RESET END OF ORDER F/F ON
RCSON   EQU     0BAH    ;RESET CUT SIGNAL F/F ON
SMCW    EQU     0BBH    ;STEP MTR CW(FORWARD)
SMRUN   EQU     0BCH    ;STEPPER MOTOR RUN
RRCON   EQU     0BDH    ;RESET REMAKE/REJECT COUNTER ON
;
SPDGN   EQU     0DCH    ;SET FREQ OF STEPPER CLK SPD GEN
DISPY   EQU     0DDH    ;BCD TO 2 DIGIT DISPLAY
;
SMOFF   EQU     0E0H    ;STEPPER MOTOR OFF
CTOFF   EQU     0E1H    ;CUT SOLENOID OFF
RRSOF   EQU     0E2H    ;REMAKE-REJECT SENSOR NOT ENABLED
AVCOF   EQU     0E3H    ;ADVANCE COMPLETE OFF
EOOOF   EQU     0E4H    ;END OF ORDER OFF
PCTOF   EQU     0E5H    ;PRINT CUT OFF
SMON    EQU     0E8H    ;STEPPER MTR ON
CTON    EQU     0E9H    ;CUT SOLENOID ON
RRSON   EQU     0EAH    ;REMAKE-REJECT SENSOR ENABLED
AVCON   EQU     0EBH    ;ADVANCE COMPLETE ON
EOOON   EQU     0ECH    ;END OF ORDER ON
PCTON   EQU     0EDH    ;PRINT CUT ON
;
;ROUTINE EQUATES
;
ADVSW   EQU     04      ;DIAGNOSTIC ADVANCE SWITCH
CUTL    EQU     15      ;CUTL*1.0 MSEC=CUT SOL ON TIME
CUTTM   EQU     52      ;CUTTM*1.0MSEC=KNIFE RET TIME
CWIND   EQU     10      ;+ CR - VARIATION OF CUT MARK
                        ;LOCATION(# OF STEPS)
DSTOR   EQU     0FF80H  ;START OF DATA STORAGE
INITC   EQU     40H     ;INITIATE CONTINUE
MXMCM   EQU     2       ;MAX NUMBER OF MISSING CUT MARKS
PEDGE   EQU     110     ;PRINT EDGE TO KNIFE FEED LENGTH
SPDTB   EQU     700H    ;START OF LOOK UP TABLES
STOPS   EQU     700     ;STOP SWITCH INTERRUPT
WHY0    EQU     0       ;TEST FOR NORMAL OPERATION
WHY4    EQU     STOPS   ;STOP SWITCH SELECTED
;
;ROUTINE:INIT
;
;THIS ROUTINE IS FOR INITIAL START UP AND THE
;INTERRUPTS.
;
INIT:
        LXI     H,DSTOR
        SPHL            ;INITIALIZE STACK POINTER
        JMP     INITC   ;ALLOW SPACE FOR FUTURE INTERRUPTS
        ORG     STOPS
STOPS:                  ;STOP SWITCH
        CALL    STOP    ;SAVE REASON FOR STOP & DISPLAY
                        ;PRINT COUNT
        POP     H       ;DUMP RETURN ADDRESS
        JMP     WORK
        ORG     INITC
INITC:                  ;INITIATE CONTINUED
        MVI     A,89H   ;A,B-OUTPUT C-INPUT
        OUT     DISPY+2 ;CONTROL TO PPI
        XRA     A       ;SET A =0
        CALL    NMOT2   ;SHOW DISPLAY=0
INITM:                  ;INITIALIZE MEMORY
        MOV     M,A     ;ALL DSTORE=0
        INR     L
        JNZ     INITM   ;IF HL=/0,JUMP
;
;ROUTINE:WORK
;
;THIS ROUTINE READS THE CONTROL SWITCHES AND STORES
;THE INFORMATION IN THE APPROPIATE LOCATION IN BINARY.
;
```

```
WORK:
        OUT     SMSTP   ;STOP STEPPER MOTOR
        OUT     SMOFF   ;TURN OFF STEPPER MOTOR
        OUT     REOON   ;RESET END OF ORDER F/F
        OUT     REOOF
        OUT     AVCOF   ;TURN OFF ADVANCE COMPLETE
        OUT     EOOOF   ;TURN OFF END OF ORDER
        XRA     A       ;A=0
        STA     TOT1?   ;CLEAR FIRST TOTAL DISPLAYED
        STA     STOPM   ;RESET STOP IF SET
        STA     REOCM   ;CLEAR CUT MARK REQUIRED
        LXI     H,DSTOR ;RE-INITIALIZE STACK POINTER
        SPHL
        EI              ;ALLOW STOP SWITCH TO INTERRUPT
WORK1:
        LXI     D,SWSTM ;SWITCH STORAGE MEMORY
        LXI     H,IDVSW ;LOCATION OF INDIVIDUAL SWITCHES
        LDAX    D       ;OLD SWITCH STATE TO A
        MOV     C,A     ;SAVE OLD SWITCH STATES
CHECK:
        MOV     A,M     ;GET PRESENT SWITCH STATES
        MOV     B,A     ;SAVE SWITCH STATES
        XRA     C       ;STATES CHANGED?
        JZ      CHECK   ;NO, TRY AGAIN
        RRC
        RRC             ;TRIM CHANGE SETS CARRY
        JNC     PAKIN
        MVI     A,20    ;LOAD A FOR 20 MILLISECONDS
                        ;IF TRIM CHANGED
        JMP     DEBON
PAKIN:                  ;PACKER INPUT
        RRC             ;START ON SETS CARRY
        JNC     DEBON-2
        IN      PACK    ;PACKER CONNECTED
        ANA     A       ;SET FLAGS
        JM      DEBON-2
        CALL    DMS2    ;DEBOUNCE PACKER START INPUT 0.5 MS
        JMP     DEBON+3
        MVI     A,2     ;LOAD A FOR 2 MILLISECONDS
DEBON:                  ;DEBOUNCE
        CALL    DELAY   ;YES,DEBOUNCE SWITCH
        MOV     A,M     ;GET PRESENT SWITCH STATES
        XRA     B       ;HAVE ANY SWITCHES CHANGED?
        JNZ     CHECK   ;YES,TRY AGAIN
        MOV     A,B     ;NO, SWITCH STATES TO ACCUM
        STAX    D       ;SAVE SWITCH POSITION
        RRC             ;NO CUT MARK TO CARRY & A7
        INX     D       ;DE=NCTMS(NO CUT MARK STATUS)
        STAX    D       ;STORE NO CUT MARK STATUS
        RRC             ;TRIM TO CARRY
        CC      TRIM
        RRC             ;START TO CARRY
        JNC     WORK1
        RRC             ;MODE TO A0-A3
        ANI     0FH     ;SAVE MODE # & SET FLAGS
        EI
PROT1:  IF      PROT
        JZ      BEGIN   ;MODE 0?(     )
        DCR     A
        JZ      BEG1    ;MODE 1?(RUN)
        DCR     A
        JZ      MLEGT   ;MODE 2?(FEEDL)
        DCR     A
        JZ      MFACM   ;MODE 3?(FEEDA)
        DCR     A
        JZ      TOTAL   ;MODE 4?(TOTAL)
        DCR     A
        JZ      SENSE   ;MODE 5?(SENSE)
        DCR     A
        JZ      DIAG    ;MODE 6?(     )
        DCR     A
        JZ      WORK    ;MODE 7?(     )
        DCR     A
        JZ      WORK    ;MODE 8?(     )
```

```
        DCR     A
        JZ      TEST    ;MODE 9?(TEST)
        ENDIF
BEGIN:                  ;BEGINNING OF ORDER (CUT MARKS REQUIRED)
        MVI     A,80H
        STA     REQCM   ;SET CUT MARK REQUIRED
BEG1:                   ;BEGINNING OF ORDER (MISSING CUT MARKS ACCEPTABLE)
        PUSH    H
        LXI     H,WHY   ;LOWER BYTE ADDRESS OF LAST STOP
        MVI     A,WHY2+3 AND 0FFH       ;LOWER BYTE OF CUT MARK
                                        ;WRONG LOCATION ADDRESS
        CMP     M       ;LOWER ADDRESS BYTES EQUAL?
        MVI     M,0     ;CLEAR LOWER ADDRESS BYTE
        INX     H       ;HIGH BYTE ADDRESS OF LAST STOP
        JNZ     TEST4   ;JUMP IF LOWER ADDRESS BYTES NOT EQUAL
        MVI     A,(WHY2+3) SHR 8        ;HIGH BYTE OF CUT MARK
                                ;WRONG LOCATION ADDRESS
        CMP     M       ;HIGH ADDRESS BYTES EQUAL?
TEST4:
        MVI     A,0
        MOV     M,A     ;CLEAR HIGH ADDRESS BYTE
        POP     H       ;RESTORE H
        JZ      TEST5   ;SAVE PREVIOUS PRINT COUNT
        STA     PRCT    ;SET PRINT COUNT TO ZERO
TEST5:
        STA     STOPM   ;RESET STOP IF SET
        OUT     SMON    ;TURN MOTOR ON
        MVI     A,18
        CALL    DELAY   ;KEEP MOTOR ON 18 MSEC
        IN      PREOO   ;NEW ROLL OF PAPER IF SET
        MOV     B,A     ;SAVE STATUS
        LDA     PWRON   ;ZERO IF JUST TURNED ON
        XRI     80H     ;COMPLEMENT MSB
        ORA     B       ;BIT 7 HI IF LONG FEED REQUIRED
        INX     D       ;D=LONFD(LONG FEED)
        STAX    D
        DCX     H       ;M=MXPRS(MAX PRINTS SW)
        INX     D       ;D=MXPRM(MAX PRINTS MEM)
        MOV     A,M     ;MAX NUMBER PRINTS TO A
        STAX    D       ;STORE MAX PRINTS
        DCX     H       ;M=SPDSL(SPEED SELECT SW)
;
PSTAR:                  ;PRINT START
;
;INPUTS:DE=MXPRM(MAX PRINTS MEMORY ADDRESS)
;       HL=SPDSL(SPEED SELECT SWITCH ADDRESS)
;
        OUT     REOON   ;CLEAR END OF ORDER F/F
        MOV     A,M     ;SPEED SELECT IN
        ANI     0FH     ;MASK OFF UPPER 4 BITS
        MOV     B,A     ;SAVE SPEED SELECT
        CPI     9       ;TOP SPEED SELECTED?
        MVI     A,0     ;A7=0
        JNZ     CONT1   ;NO, THAN JUMP
        IN      PACK    ;BIT 7 LO IF PACKER USED
        ANI     80H     ;SET BIT 7 HI IF PACKER
                        ;NOT USED
CONT1:                  ;CONTINUE 1
        STA     CTELY   ;STORE CUT EARLY
        MOV     A,B     ;RESTORE SPEED SELECTED
        PUSH    H
        LXI     H,SPDTB ;SPEED TABLE
        ADD     L
        MOV     L,A     ;SPDTB+A TO L
        MOV     A,M     ;LOOK UP MAX SPEED
        STA     MXSPD   ;STORE MAX SPEED
        POP     H
        DCX     H       ;M=CTOUT(CUT OUT LENGTH SW)
        MOV     B,M     ;GET CUT OUT LENGTH
        CALL    BCDBI   ;CHANGE TO BINARY
        INX     D       ;D=CTOTM(CUT OUT LENGTH MEM)
        STAX    D       ;STORE BINARY CUT OUT LENGTH
        DCX     H       ;M=CTFD2(FEED AFTER CUT 2)
        MOV     A,M     ;MSD OF SWITCH
```

```
        ANI     0FH         ;MASK OFF UPPER 4 BITS
        DCX     H           ;M=CTFD1(FEED AFTER CUT 1)
        MOV     B,M         ;2 LSD OF SWITCH
        CALL    BCDBI+2     ;CHANGE TO BINARY
        MOV     C,A         ;SAVE 2 LSD
        LDAX    D           ;GET CUT OUT LENGTH
        ANA     A           ;SET FLAGS
        CNZ     CDADJ       ;MAKE ADJUSTMENT FOR CUT OUT
        MOV     A,C         ;GET ADJUSTED 2 LSD
        INX     D           ;D=ACTF1(AFTER CUT MARK FEED 1)
        STAX    D           ;2 LSD BINARY STORED
        INX     D           ;D=ACTF2(AFTER MARK FEED 2)
        MOV     A,B         ;MSD TO A
        STAX    D           ;MSD BINARY STORED
        DCX     H           ;M=PAFD2(PAPER FEED LENGTH 2)
        MOV     A,M         ;MSD OF SWITCH
        DCX     H           ;M=PAFD1(PAPER FEED LENGTH 1)
        MOV     B,M         ;2 LSD OF SWITCH
        CALL    BCDBI+2     ;CHANGE TO BINARY
        MOV     C,A         ;SAVE 2 LSD OF BINARY PAPER FEED REQUIRED
        LDA     CTOTM       ;CUT OUT LENGTH
        ANA     A           ;SET FLAGS
        CNZ     CDADJ+1     ;MAKE ADJUSTMENT FOR CUT OUT
        LDA     NCTMS       ;NO CUT MARK STATUS
        RLC                 ;STATUS TO CARRY
        XCHG                ;M=ACTF2(AFTER CUT MARK FEED 2)
        CALL    MOTON       ;TURN MOTOR ON AND SET
                            ;MOTOR DIRECTION TO FORWARD
        JC      MOV1        ;JUMP IF NO CUT MARK
        OUT     REOOF       ;ENABLE END OF ORDER MARK
        LDA     LONFD       ;LONG FEED
        ANA     A           ;SET FLAGS
        JP      MINFD       ;IF NOT LONG FEED, JUMP
        LXI     B,1500
        JMP     MOV1+2
;
;THIS ROUTINE DETERMINES THE  MINIMUM FEED
;ALLOWED FOR A CUT MARK TO BE ACCEPTED.  IT SUBTRACTS THE
;FEED AFTER CUT MARK AND HALF THE "WINDOW" THE CUT MARK
;SHOULD BE PRESENT IN FROM THE TOTAL PRINT FEED LENGTH.

;
MINFD:                      ;MINIMUM FEED
        MOV     A,C         ;GET 2 LSD OF FEED LENGTH
        DCX     H           ;M=ACTF1(AFTER CUT MARK FEED LENGTH 1)
        SUB     M           ;2 LSD OF FEED BEFORE CUT MARK
        JNC     CONT2       ;IF NO CARRY SKIP NEXT 2
        DCR     B           ;SUBTRACT BORROW
CONT2:                      ;CONTINUE 2
        SUI     CWIND       ;2 LSD OF FEED BEFORE CUT
                            ;MARK WINDOW
        MOV     C,A         ;C=2 LSD OF FEED BEFORE CUT MARK WINDOW
        INX     H           ;M=ACTF2(AFTER CUT MARK FEED 2)
        MOV     A,B         ;MSD OF FEED LENGTH
        SBB     M           ;MSD OF FEED BEFORE CUT MARK WINDOW
        MOV     B,A         ;B=MSD OF FEED BEFORE CUT MARK WINDOW
;
;ROUTINE:MOVE
;
;THIS ROUTINE DETERMINES THE MOVEMENT OF THE STEPPER
;MOTOR.  IF CUT MARK IS USED, BC CONTAINS THE NUMBER OF STEPS
;TO BE MOVED(1)BEFORE A CUT MARK IS VALID (OMITTED ON FIRST
;PRINT IN A ROLL OF PAPER OR AFTER POWER IS TURNED ON),
;(2)WHILE A CUT MARK IS VALID,(3)BEFORE RAMP DOWN,
;(4)UNTIL THE END OF PRINT.  IF NO CUT MARK IS
;USED, BC CONTAINS THE NUMBER OF STEPS TO BE
;MOVED(1)UNTIL THE END OF PRINT,(2) BEFORE RAMP
;DOWN(CORRECTED AFTER RAMP UP IS COMPLETE),(3) UNTIL
;THE END OF PRINT.
;
;INPUTS:BC-SEE ABOVE
;
;OUTPUTS:DE-TOTAL STEPS MOVED
;
MOV1:
```

```
        OUT     RCSON   ;DISABLE CUT SIGNAL IN
        OUT     RRSON   ;ENABLE REMAKE-REJECT SENSOR
        XRA     A       ;A=0
        MOV     D,A     ;D=0
        MOV     E,A     ;E=0
        INX     H       ;M=MSPDS(MAX SPEED STATUS)
        MOV     M,A     ;CLEAR MAX SPEED STATUS
        INX     H
        INX     H       ;M=RSTPN(RAMP STEP NUMBER)
        MOV     M,A     ;RAMP STEP #=0
        INX     H       ;M=URAPS(UP RAMP STATUS)
        MVI     M,80H   ;UP RAMP STATUS SET
        INX     H       ;M=RRPDN(READY RAMP DOWN)
        MOV     M,D     ;CLEAR READY TO RAMP DN
        INX     H       ;M=ACTM(AFTER CUT MARK)
        MOV     M,D     ;CLEAR AFTER CUT MARK
        INX     H       ;M=CTVAL(CUT MARK VALID)
        LDA     LONFD   ;BIT 7 HI IF LONG FEED
        MOV     M,A     ;CUT MARK VALID IF LONG
                        ;FEED, OTHERWISE NOT VALID
CLK1:
        CALL    CLK     ;CHECK STEP & CUT SIGNAL
        JP      STEP    ;IF NO CUT SIGNAL JUMP
        OUT     RCSON   ;RESET CUT SIGNAL F/F ON
        STA     CTMNW   ;STORE CUT MARK THIS PRINT
        CALL    CMARK   ;CHANGE APPROPIATE FLAGS
        LHLD    ACTF1   ;FEED AFTER CUT MARK
        MOV     B,H     ;MOVE TO BC
        MOV     C,L
STEP:
        CALL    SMSPD   ;YES,CHECK SPEED
        INX     D       ;MOTOR STEP TOTAL
        DCR     C       ;DECREMENT BC
        JZ      BC0?
        MVI     A,0FFH
        CMP     C       ;C=FF?
        JNZ     CLK1
        DCR     B
        JMP     CLK1
BC0?:                   ;BC=0?
        XRA     A       ;A=0
        CMP     B
        JNZ     CLK1    ;JUMP IF BC=/0
;
;ROUTINE:TST
;
;THIS ROUTINE DETERMINES IF A CUT MARK IS ACCEPTABLE
;AND ALSO DETERMINES THE FEED LENGTH IF THERE IS NO
;CUT MARK.  IF THE CUT MARK OR ITS SUBSTITION HAS BEEN
;SENSED, AN INDICATION IS PROVIDED.
;
TEST1:
        LDA     NCTMS   ;NO CUT MARK STATUS
        ANA     A       ;SET FLAGS
        MVI     A,0     ;ZERO A REG, NO FLAG CHANGE
        LXI     H,RRPDN ;READY TO RAMP DOWN
        JM      RAMPD   ;JUMP IF NO CUT MARK STATUS
        CMP     M       ;READY TO RAMP DOWN
        JZ      ENDP?   ;NO, THEN CHECK END OF PRINT
RAMPD:                  ;RAMP DOWN
        MOV     M,A     ;CLEAR READY TO RAMP DOWN
        DCX     H
        DCX     H       ;M=RSTPN(RAMP STEP NUMBER)
        MOV     B,A     ;B=0
        MOV     C,M     ;C=NUMBER STEPS TIL END OF PRINT
        CMP     C       ;C=0
        JZ      ENDPR   ;YES,END  OF PRINT
        DCX     H
        DCX     H       ;M=MSPDS(MAX SPEED STATUS)
        MOV     M,A     ;CLEAR MAX SPEED
        LDA     CTELY   ;CUT EARLY
        ANA     A       ;SET FLAGS
        JP      CLK1    ;JUMP IF NOT EARLY CUT
        OUT     CTON    ;TURN ON CUT SOLENOID
        JMP     CLK1
```

```
ENDP?:                          ;CHECK FOR END OF PRINT
        INX     H               ;M=ACTM(AFTER CUT MARK)
        CMP     M
        JNZ     ENDPR           ;JUMP IF AFTER CUT MARK
        INX     H               ;M=CTVAL(CUT MARK VALID)
        CMP     M               ;LOOKING FOR CUT MARK?
        JNZ     NOCTM           ;YES, GO TO NO CUT MARK SENSED
        OUT     RCSOF           ;ENABLE CUT SIGNAL
        LXI     B,?*CWIND               ;BC=CUT MARK WINDOW
        MVI     A,80H
        MOV     M,A             ;SET CUT VALID
        JMP     CLK1
NOCTM:                          ;NO CUT MARK SENSED
        MOV     M,A             ;CLEAR CUT MARK VALID
        OUT     RCSON           ;DISABLE CUT SIGNAL
        STA     CTMNW           ;CLEAR CUT MARK THIS PRINT
        DCX     H               ;M=ACTM(AFTER CUT MARK)
        LDA     LONFD           ;LONG FEED STATUS
        ANA     A               ;SET FLAGS
        JP      WHY1+6
WHY1:
        CALL    STOP            ;NO CUT MARK YET SO STOP
        JMP     WORK
        INX     H
        INX     H               ;M=MISCM(CUT MARK YET TO MISS)
        DCR     M
        LDA     REQCM           ;BIT 7 HI IF CUT MARK REQUIRED
        ORA     M
        JP      WHY2+6
WHY2:
        CALL    STOP            ;STOP IF TOO MANY MISSING MARKS
        JMP     WORK
        INX     H               ;M=PFD1(PAPER FEED 1)
        MOV     A,M
        SUB     E
        MOV     C,A
        INX     H               ;M=PFD2(PAPER FEED 2)
        MOV     A,M
        SBB     D
        MOV     B,A             ;BC=STEPS TO END OF PRINT
        LDA     RSTPN           ;GET NUMBER OF RAMP DOWN STEPS
        CMA
        MOV     L,A
        CALL    RPDNA           ;CORRECT FOR RAMP DOWN STEPS
        MVI     A,80H           ;SET BIT 7
        CALL    CMARK           ;CHANGE APPROPIATE FLAGS
        JMP     CLK1
;
;THIS ROUTINE SETS APPROPIATE FLAGS AFTER A CUT
;MARK HAS BEEN SENSED OR AFTER A MISSING CUT MARK
;HAS BEEN ACCEPTED.
;
;INPUTS:BIT 7 OF A REG IS SET HI
;
CMARK:                          ;CUT MARK
;
        LXI     H,RRPDN         ;READY TO RAMP DOWN
        MOV     M,A             ;STORE READY TO RAMP DN
        INX     H               ;M=ACTM(AFTER CUT MARK)
        MOV     M,A             ;STORE AFTER CUT MARK
        INX     H               ;M=CTVAL(CUT MARK VALID)
        XRA     A               ;A=0
        MOV     M,A             ;CLEAR CUT MARK  VALID
        RET
;
;ROUTINE:SETUP
;
;THIS ROUTINE CONTAINS THE NECESSARY FUNCTIONS FOR
;INITIAL SET UP CALIBRATION OF THE PAPER CUTTER.THESE
;FUNCTIONS ARE:
;       MLEGT-MEASURES THE LENGTH OF THE PRINT FROM CUT
;MARK TO CUT MARK.
;       MFACM-MEASURES THE DISTANCE THE PAPER MOVES AFTER
;THE CUTMARK IS SENSED UNTIL IT IS CUT.  IT REQUIRES THE
;OPERATOR TO POSITION THE LEADING EDGE OF THE PRINT TO A
```

```
;PREDETERMINED POINT.
;
MLEGT:                          ;MEASURE LENGTH
        CALL    MOTON
        LXI     D,0             ;RESET FEED LENGTH
CLK1C:                          ;CLOCK CALL 1
        CALL    CLK             ;TAKE STEP
        JM      CLK2C-3         ;IF CUT MARK,JUMP
        CALL    CT999           ;INCREMENT FEED LENGTH DE
        JZ      FEEDL           ;FEED TOO LONG
        JMP     CLK1C
        LXI     D,0             ;RESET FEED LENGTH
CLK2C:                          ;CLOCK CALL 2
        CALL    CLK             ;TAKE STEP
        JM      FEED1           ;IF CUT MARK SENSED,JUMP
        CALL    CT999           ;INCREMENT FEED LENGTH DE
        JZ      FEEDL           ;FEED TOO LONG
        JMP     CLK2C           ;TAKE A STEP
FEED1:                          ;MEASURED FEED LENGTH
        OUT     SMSTP           ;STOP STEPPER MOTOR
        MOV     A,E             ;SET UP FOR DISPLAY
        CALL    NMOT4
        XCHG                    ;MOVE MEASURED FEED LENGTH TO HL
        SHLD    MFDL            ;SAVE MEASURED FEED LENGTH
        JMP     FEEDL
MFACM:                          ;MEASURE FEED AFTER CUT MARK
        CALL    MOTON
        IN      COREC           ;GET KNIFE TO PRINT EDGE CORRECTION
        ANI     01FH            ;MASK OUT UPPER 3 BITS
        MVI     B,PEDGE         ;GET PRINT EDGE TO KNIFE LENGTH.
        ADD     B               ;ADD CORRECTION
        MOV     B,A             ;SAVE LENGTH
CLK3C:                          ;CLOCK CALL 3
        CALL    CLK             ;TAKE STEP
        DCR     B               ;B=DISTANCE TO KNIFE
        JM      CLK4C-6         ;IF EDGE AT KNIFE JUMP
        JMP     CLK3C           ;IF NOT, TAKE A STEP
        LXI     D,0
        CALL    CT999           ;INCREMENT DE
        JZ      FEEDL           ;FEED TOO LONG
CLK4C:                          ;CLOCK CALL 4
        CALL    CLK             ;TAKE STEP
        JM      FEED2           ;IF CUT MARK JUMP
        JMP     CLK4C-6
FEED2:
        OUT     SMSTP           ;STOP STEPPER MOTOR
        LHLD    MFDL            ;MEASURED FEED LENGTH
        MOV     A,D             ;BCD FEED BEFORE CUT MARK
        MOV     B,E
        CALL    BCDBI+2         ;CONVERT TO BINARY
        MOV     D,B             ;BINARY FEED BEFORE CUT
        MOV     E,A
        MOV     A,H             ;BCD FEED LENGTH
        MOV     B,L
        CALL    BCDBI+2         ;CONVERT TO BINARY
        SUB     E               ;DETERMINE 2 LSD
        MOV     E,A             ;SAVE 2 LSD
        MOV     A,B             ;MSD OF BINARY FEED LENGTH
        SBB     D               ;DETERMINE MSD
        MOV     D,A
        CALL    BIBCD           ;CONVER TO BCD
        MOV     E,A             ;SAVE 2 LSD
        CALL    NMOT4           ;DISPLAY MEASURED FEED AFTER CUT
                                ;MARK LENGTH
        XCHG
        SHLD    MFDAC           ;SAVE MEASURED FEED AFTER
                                ;CUT MARK LENGTH

FEEDL:                          ;FEED LONG
        XRA     A               ;A=0
        STA     PWRON           ;CLEAR  PWRON
        JMP     WORK
MOTON:                          ;MOTOR ON
        MVI     A,16H           ;SLOW SPEED SELECT
        OUT     SPDGN           ;SLOW SPEED OUT
```

```
        OUT     SMCW    ;STEPPER MTR CW(FORWARD)
        OUT     SMON    ;TURN ON STEPPER MTR
        OUT     SMRUN   ;RUN STEPPER MOTOR
        OUT     RCKON   ;RESET STEP COMP F/F
        OUT     RCKOF
        OUT     RCSON   ;CLEAR CUT SIGNAL F/F
        OUT     RCSOF
        RET
;
;THIS CALL LOOKS FOR THE STEPPER MOTOR TO COMPLETE
;ONE STEP.  IF THE STEP HAS NOT BEEN COMPLETED WITHIN
;APPROXIMATELY 5 MILLISECONDS, CONTROL WILL BE
;RETURNED TO "WORK" WHERE THE STACK WILL BE INITILIZED
;TO REMOVE THE RETURN ADDRESS & DATA SAVED ON THE
;STACK.  UPON STEP COMPLETION, THE MINUS FLAG IS SET
;IF A CUT MARK HAS BEEN SENSED.
;
CLK:                    ;STEPPER MOTOR CLOCK
        PUSH    B
        MVI     B,0     ;TIME OUT COUNTER
        INR     B       ;INCREMENT TIMER
        JNZ     WHY3+6
WHY3:
        CALL    STOP
        JMP     WORK
        IN      STEPC   ;STEP COMPLETE
        ANA     A       ;SET FLAGS
        JP      CLK+3   ;NO, TRY AGAIN
        POP     B
        OUT     RCKON   ;RESET STEP COMP F/F
        OUT     RCKOF
        IN      CTSIG   ;GET CUT SIGNAL
        ANA     A       ;SET FLAGS
        RP              ;IF NO SIGNAL, RETURN
        OUT     RCSON   ;CLEAR CUT SIGNAL F/F
        OUT     RCSOF
        RET
;
;THIS CALL INCREMENTS THE BCD CONTENTS OF REGISTER
;PAIR DE BY ONE COUNT.  IF THE COUNT IS LESS THAN
;1000, ZERO IS NOT SET ON RETURN.
;
CT999:                  ;COUNT DE TO 999
        ANA     A       ;CLEAR CARRY
        MOV     A,E     ;GET 2 LSD
        INR     A       ;INCREMENT 2 LSD
        DAA             ;MAKE SURE THEY ARE BCD
        MOV     E,A     ;SAVE 2 LSD
        RNC             ;IF NO CARRY RETURN
        MOV     A,D     ;GET MSD
        INR     A       ;INCREMENT MSD
        MOV     D,A     ;SAVE MSD
        CPI     0AH     ;ZERO FLAG SET IF DE=1000
        RET
;
;ROUTINE:TOTA
;
;THIS ROUTINE DISPLAYS THE TOTALS OF PRINTS CUT
;& ORDERS COMPLETED SINCE POWER ON. THE FOLLOWING
;SEQUENCE IS USED TO DISPLAY THE DATA:(1) 2 MSD OF
;PRINTS CUT,(2) 4 LSD OF PRINTS CUT,(3) 2 MSD OF
;ORDERS CUT,(4) 4 LSD OF ORDERS CUT.  AFTER (4) HAS
;BEEN DISPLAYED, THE SEQUENCE STARTS OVER AT (1).
;
;DESTROYS:A,B
;
TOTAL:
        LDA     TOT1?   ;BIT 7 HI IF THIS IS
                        ;FIRST TOTAL DISPLAYED
        ANA     A       ;SET FLAGS
        JM      TOT2    ;JUMP IF NOT FIRST DISP
        MVI     B,4     ;SET NUMBER OF PASSES
        LXI     H,PRCT1+2       ;2 MSD OF PRINTS CUT
DIG2:                   ;DISPLAY 2 DIGITS
        MOV     A,M     ;GET 2 DIGITS
```

```
        CALL    NMOT2   ;DISPLAY 2 DIGITS
        MVI     A,80H
        STA     TOT1?   ;SET FIRST TOTAL DISPLAYED
TOT3:
        STA     DIG4S   ;STORE DISPLAY 4 DIGITS STATUS
        PUSH    h       ;SAVE LOCATION OF LAST
                        ;DIGITS DISPLAYED
        DCR     B       ;DECREMENT PASS COUNTER
        LXI     D,SWSTM ;SWITCH STATUS MEMORY
        PUSH    B       ;SAVE PASS COUNTER
        JNZ     WORK1   ;JUMP IF NOT LAST PASS
        JMP     WORK    ;CLEAR TOT1? THIS TIME
TOT2:
        POP     B       ;GET PASS COUNTER
        POP     H       ;GET LOCATION OF LAST DIGITS DISPLAYED
        DCX     H       ;LOCATION OF NEXT 2 DIGITS
                        ;TO BE DISPLAYED
        LDA     DIG4S   ;BIT 7 HI IF 4 DIGITS
        ANA     A       ;SET FLAGS
        JP      DIG2    ;JUMP IF 2 DIGITS TO BE DISPLAYED
        MOV     D,M     ;2 MSD TO BE DISPLAYED TO D
        DCX     h
        MOV     A,M     ;2 LSD TO A
        STC             ;SHOWING LEADING ZEROS
        CALL    NMOT4   ;DISPLAY 4 DIGITS
        XRA     A       ;A=0
        JMP     TOT3
;
;ROUTINE:SENS
;
;THIS ROUTINE ALLOWS THE CUT MARK TO BE
;MOVED BACK AND FORTH IN FRONT OF THE SENSOR
;SO THAT IT MAY BE PROPERLY ADJUSTED.
;
SENSE:
        CALL    MOTON   ;TURN MOTOR ON
        LXI     D,400   ;START COUNT AT 400
NMARK:                  ;CHECK FOR MARK
        CALL    CT999
        JZ      FEEDL   ;FEED TOO LONG
        CALL    CLK
        JP      NMARK   ;IF NO CUT MARK JUMP
        MVI     B,50    ;PRELOAD STEP COUNT
FWD:                    ;FORWARD DIRECTION
        CALL    CLKS
        JM      FEEDL   ;GO BACK IF STOP SW SELECTED
        OUT     SMCCW   ;GO BACKWARDS
REV:                    ;REVERSE DIRECTION
        CALL    CLKS
        JM      FEEDL   ;GO BACK IF STOP SW SELECTED
        OUT     SMCW    ;GO TOWARDS KNIFE
        JMP     FWD
CLKS:                   ;SENSOR CLOCK
        CALL    CLK
        DCR     B       ;DECREMENT STEP COUNT
        JNZ     CLKS    ;IF STEP COUNT =/ 0 TAKE
                        ;ANOTHER STEP
        MVI     B,100   ;PRELOAD STEP COUNT
        LDA     STOPM   ;BIT 7 HI IF STOP SWITCH
                        ;ENERGIZED
        ANA     A       ;SET FLAGS
        RP              ;GO BACK IF NOT READY TO STOP
        MVI     A,0     ;A=0 & FLAGS NOT CHANGED
        STA     STOPM   ;CLEAR STOP
        RET
;
;ROUTINE:STOP
;
;THIS ROUTINE WILL DISPLAY THE NUMBER OF PRINTS
;CUT IN THE PRESENT ORDER IF THE CUTTER HAS
;STOPPED.  IT WILL STORE THE ADDRESS THAT CAUSED
;IT TO STOP.
;
STOP:
        XRA     A       ;A=0
```

```
        STA     PWRON   ;ALLOW LONG FEED NEXT TIME
        STA     CTMNW   ;NO CUT MARK ON LAST PRINT
STOP1:
        LDA     PRCT    ;NUMBER OF PRINTS CUT
                        ;THIS ORDER
        ANA     A       ;CLEAR CARRY FOR LEADING
                        ;ZERO SUPPRESSION
        CALL    NMOT2   ;DISPLAY PRINTS CUT
        POP     H       ;WHAT ADDRESS CAUSED STOP
        SHLD    WHY     ;SAVE FOR FUTURE CHECK
        PUSH    H       ;PUT BACK FOR RETURN
        RET
;
;ROUTINE:ENDP
;
;THIS ROUTINE PERFORMS THE NECESSARY FUNCTIONS THAT TAKE
;PLACE AT THE END OF A PRINT.
;
ENDPR:                  ;END OF PRINT
        OUT     RRSOF   ;DISABLE REMAKE-REJECT SENSOR
        OUT     AVCON   ;TELL PACKER READY TO CUT
        OUT     SMSTP   ;STEPPER MOTOR STOP
        IN      PREOO   ;PRINT END OF ORDER
        ANA     A
        MOV     B,A     ;SAVE END OF ORDER STATUS
        JP      NEOO
        OUT     EOOON   ;END OF ORDER TO PACKER
NEOO:                   ;NO END OF ORDER
        IN      PACK    ;PACKER STATUS
        ANA     A       ;SET FLAGS
        JM      NPAC1
        LXI     H,0
NIFEN:                  ;KNIFE ENABLE
        LDA     STOPM   ;OPERATOR TIRED OF WAITING?
        CPI     80H
        JNZ     WHY6+6
WHY6:   CALL    STOP1
        JMP     WORK
        INR     L       ;DELAYS UNTIL HL OVERFLOWS
        JNZ     NIFIN
        INR     H
        JNZ     NIFIN
        OUT     SMOFF   ;TURN OFF STEPPER MTR IF
                        ;TOO LONG A WAIT
NIFIN:                  ;INPUT KNIFE ENABLE
        IN      KNIFE   ;PACKER KNIFE ENABLE
        ANA     A       ;SET FLAGS
        JM      NIFEN   ;SIGNAL HERE?
        CALL    DMS2    ;YES, DEBOUNCE 0.5 MSEC.
        IN      KNIFE
        ANA     A
        JM      NIFEN
        OUT     SMON    ;TURN MOTOR ON FOR CUT
NPAC1:                  ;NO PACKER
        OUT     AVCOF   ;TURN OFF ADVANCE COMPLETE
        PUSH    PSW
        LDA     CTFLY   ;CUT EARLY
        ANA     A       ;SET FLAGS
        OUT     PCTON   ;PRINT CUT (ON) TO PACKER
        CP      TRIM    ;IF NOT EARLY CUT
        CM      TRIM1   ;IF EARLY CUT, TAKE LESS TIME
        POP     PSW
        LXI     H,PRCT  ;PRINTS CUT THIS ORDER
        MOV     A,M     ;GET PRINTS CUT THIS ORDER
        INR     A       ;NEW PRINT COUNT
        DAA
        MOV     M,A     ;SAVE NEW COUNT
        MOV     C,A     ;PRINTS THIS ORDER
        IN      PACK    ;PACKER CONNECTED?
        CMA
        ORA     B       ;COMBINE STATUS CONDITIONS
        JP      DSPRT+3 ;JUMP IF NEITHER
        MOV     A,C     ;GET COUNT BACK FOR OUTPUT
DSPRT:                  ;DISPLAY PRINT COUNT
        CALL    NMOT2   ;SHOW NEW COUNT
```

```
        LXI     H,MXPRM ;M=MX NUMBER OF PRINTS THIS ORDER
        MOV     A,M
        CPI     0       ;CONTINOUS CUT IF 0
        JNZ     MXPR?
        MOV     C,A
        INR     A       ;MAKE A>C
MXPR?:                  ;MAXIMUM NUMBER OF PRINTS
        SUB     C       ;A=0 IF MAX COUNT
        MOV     C,A     ;SAVE MAX COUNT STATUS
        LXI     H,ORDCT-1
        MOV     A,B     ;END OF ORDER STATUS
        XRI     80H     ;COMPLEMENT MSB
        PUSH    D       ;SAVE FEED LENGTH
        CALL    BCDIN+1 ;INCREMENT END OF ORDER
                        ;TOTAL IF APPROPIATE
        CALL    BCDIN   ;INCREMENT TOTAL PRINT COUNT
        POP     D       ;GET FEED LENGTH
        INX     H       ;M=CTMNW(CUT MARK NEW)
        MOV     A,M     ;CUT MARK THIS CUT
        ANA     A       ;SET FLAGS
        INX     H       ;M=CTMOD(CUT MARK OLD)
        JP      CTDLY   ;IF NO CUT MARK JUMP
        CMP     M
        JNZ     CTDLY   ;JUMP IF LAST PRINT NO CUT MARK
        MVI     A,MXMCM ;MAX MISSING CUT MARKS
        STA     MISCM   ;STORE ABOVE
        XCHG
        SHLD    PFD1    ;STORE FEED LENGTH OF LAST PRINT
        JMP     CTDLY+1
CTDLY:                  ;CUT DELAY FOR KNIFE RETURN
        MOV     M,A     ;CUT MARK STATUS FOR NEXT PRINT
        MVI     A,CUTTM ;CUT TIME AFTER SOLENOID IS
                        ;ENERGIZED
        CALL    DELAY   ;WAIT FOR KNIFE TO COMPLETE CYCLE
        OUT     PCTOF   ;PRINT CUT(OFF) TO PACKER
        LDA     CTOTM   ;CUT OUT LENGTH
        ANA     A       ;SET FLAGS
        JZ      TEST2   ;IF NO CUT OUT, JUMP
        OUT     SMRUN
        MOV     D,A     ;SAVE CUT OUT LENGTH
CLK2:
        CALL    CLK     ;CHECK STEP COMPLETE
        DCR     D       ;DECREASE CUT OUT LENGTH
        JNZ     CLK2    ;TO MOVE & IF NOT ZERO JUMP
        OUT     SMSTP
        CALL    TRIM
        MVI     A,CUTTM
        CALL    DELAY   ;WAIT FOR KNIFE TO COMPLETE CYCLE
TEST2:
        STA     LONFD   ;RESET LONG FEED
EOO?:                   ;END OF ORDER?
        MVI     A,80H
        STA     PWRON   ;SET FIRST PRINT CUT STATUS
        CMP     B       ;END OF ORDER?
        JZ      HOLD    ;YES, GO WAIT FOR NEXT ORDER
        MOV     A,C     ;MAX COUNT STATUS
        ANA     A       ;SET FLAGS
        JNZ     WHY5+6
WHY5:
        CALL    STOP1
        JMP     HOLD
        LXI     H,SPDSL ;SPEED SELECT
        LXI     D,MXPRM ;MAX PRINTS MEMORY
        JMP     PSTAR   ;START NEXT PRINT
HOLD:
        MVI     A,20
        CALL    DELAY
        JMP     WORK
;
;ROUTINE:BCDB
;
;THIS PROGRAM WILL TAKE 0-999 COMPLEMENTED DECIMAL AND
;CONVERT IT TO BINARY(0-3E7H).  REGISTER A CONTAINS MSD
;AND REGISTER B CONTAINS THE TWO LSD.
;
```

```
;D1=MSD        D2=2MSD        D3=LSD
;
;FUNCTION:BCDBI
;
;INPUTS:A,B CONTAIN BCD DATA
;
;OUTPUTS:A=2LSD AND B=MSD IN BINARY
;
;DESTROYS:A,B,C,FLAGS
;
BCDBI:
        MVI     A,0H        ;START FOR TWO DIGITS
        ANI     0FH         ;START FOR THREE DIGITS
                            ;MASK OFF UPPER 4 BITS
        PUSH    D
        PUSH    H
        MOV     C,A         ;SAVE D1
        RLC                 ;A=2 D1
        RLC                 ;A=4 D1
        ADD     C           ;A=5 D1
        RLC                 ;A=10 D1
        MOV     L,A         ;STORE 10 D1
        MVI     H,0         ;H=0
        MOV     A,B         ;GET D2 AND D3
        ANI     0F0H        ;SAVE D2
        RRC
        RRC
        RRC
        RRC
        ADD     L           ;A=10 D1 + D2
        MOV     L,A         ;L=10 D1 + D2
        MOV     E,L         ;E=10 D1 + D2
        MOV     D,H         ;D=0
        DAD     H           ;HL=2(10 D1 + D2)
        DAD     H           ;HL=4(10 D1 + D2)
        DAD     D           ;HL=5(10 D1 + D2)
        DAD     H           ;HL=10(10 D1 + D2)
        MOV     A,B         ;GET D2 AND D3
        ANI     0FH         ;SAVE D3
        MOV     E,A         ;DE=D3
        DAD     D           ;HL=100 D1 + 10 D2 + D3
        MOV     B,H
        MOV     A,L
        POP     H
        POP     D
        RET
;
;ROUTINE:BCDI
;
;THIS ROUTINE INCREMENTS A SIX PLACE DECIMAL
;NUMBER IN MEMORY.  INCREMENTS OCCUR AT CONDITIONAL ENTRY
;POINT ONLY IF A=0.
;
;INPUTS:HL-POINTS TO TWO LSD LESS 1 LOCATION
;
;DESTROYS:A,D,H,L
;
BCDIN:                      ;BCD  INCREMENT
        XRA     A           ;A=0
        MVI     D,4         ;CONDITIONAL ENTRY POINT
        DCR     D
        RZ                  ;RETURN IF 4TH PASS
        INX     H           ;LOCATION OF NUMBER TO BE
                            ;INCREMENTED
        ANA     A           ;SET FLAGS
        JNZ     BCDIN+3     ;DON'T INCREMENT IF A =/ 0
        MOV     A,M         ;GET 2 DIGITS
        INR     A
        DAA
        MOV     M,A         ;RETURN 2 DIGITS
        JMP     BCDIN+3     ;CONTINUE
;
;ROUTINE:BIBC
;
;THIS ROUTINE CONVERTS A BINARY NUMBER NOT
```

```
;GREATER THAN 3CEH TO BCD FORM.
;
;INPUTS:DE-CONTAINS BINARY VALUE(0-3CEH) TO BE
;CONVERTED
;
;OUTPUTS:D-CONTAINS MSD BCD IN A LOWER BITS
;        A-CONTAINS 2 LSD BCD
;
;DESTROYS:B,C,D,E,H,L
;
;FUNCTION:BTBCD
;
BIBCD:
        LXI     B,100
        CALL    DIGIT
        PUSH    H           ;SAVE MSD BCD
        LXI     B,10
        CALL    DIGIT
        MOV     A,H
        RRC
        RRC
        RRC
        RRC
        MOV     L,A         ;SAVE DIGIT
        LXI     B,1
        CALL    DIGIT
        MOV     A,H         ;GET LSD BCD
        ADD     L           ;MERGE 2 LSD BCD
        POP     D           ;RETURN MSD BCD
        RET
;
;THIS ROUTINE SUBTRACTS THE CONTENTS OF REGISTER
;PAIR BC FROM THE CONTENTS OF REGISTER PAIR
;DE. EACH TIME THE REMAINDER IS GREATER THAN OR EQUAL
;TO ZERO, THE H REGISTER(BCD DIGIT) IS INCREMENTED.
;WHEN THE REMAINDER IS LESS THAN ZERO, AN ADJUSTMENT
;IS MADE SO THAT A POSITIVE NUMBER REMAINS.
;
DIGIT:
        MVI     H,0         ;INITIALIZE DIGIT
DIO:
        MOV     A,E         ;SUBTRACT LOOP
        SUB     C
        MOV     E,A
        MOV     A,D
        SBB     B
        MOV     D,A
        JM      DI1
        INR     H           ;INCREMENT BCD DIGIT
        JMP     DIO
DI1:                        ;ADJUST FOR NEXT SEQUENCE
        MOV     A,E
        ADD     C
        MOV     E,A
        MOV     A,D
        ADC     B
        MOV     D,A
        RET
;
;ROUTINE:CCAD
;
;THIS ROUTINE SUBTRACTS EITHER THE FULL VALUE OR HALF
;VALUE IN REG A FROM THE VALUE IN REG BC.  IT IS
;USED TO ADJUST THE TOTAL FEED LENGTH AND THE
;FEED AFTER CUT MARK LENGTH WHEN THERE IS A CUT OUT.
;
;INPUTS:A,B,C
;
;OUTPUTS:B,C
;
CCADJ:                      ;CUT OUT ADJUSTMENT
        RAR                 ;ENTRY POINT FOR HALF VALUE
        PUSH    D           ;ENTRY POINT FOR FULL VALUE
        MOV     D,A         ;SAVE VALUE
        MOV     A,C         ;GET 2 LSD
```

```
        SUB     D           ;SUBTRACT VALUE
        MOV     C,A         ;SAVE 2 LSD
        MOV     A,B         ;GET MSD
        SBI     0           ;SUBTRACT BORROW IF ANY
        MOV     B,A         ;SAVE MSD
        POP     D
        RET
;
;ROUTINE:DELAY
;
;THIS ROUTINE GENERATES DELAYS IN 1 MILLISECOND
;INCREMENTS.  ACCUMULATOR CONTAINS THE (HEXADECIMAL)
;LENGTH OF THE DELAY IN MILLISECONDS.
;
;INPUTS:A
;
DELAY:
        CALL    DMSEC
        DCR     A
        JNZ     DELAY       ;TRY TIL TIME IS UP
        RET
;
;ROUTINE:DMSEC
;
;THIS ROUTINE GENERATES A 1.0 OR 0.5 MILLISECOND
;DELAY AND RETURNS AFTER THE DELAY IS COMPLETE
;
DMSEC:                      ;DELAY 1 MILLISECOND
        PUSH    PSW
        MVI     A,124       ;A=124
        INR     A
        JNZ     DMSEC+3
        POP     PSW
        RET
DMS2:                       ;DELAY 0.5 MSEC.
        MVI     A,190
        INR     A
        JNZ     DMS2+2
        RET
;
;ROUTINE:DISP
;
;THIS ROUTINE ALLOWS EITHER 2 OR 4 DIGITS TO BE
;DISPLAYED ON THE DIGITAL READOUT.  IF CARRY IS
;SET ON ENTRY,LEADING ZEROS WILL NOT BE SUPPRESSED.
;IF CARRY IS NOT SET ON ENTRY, LEADING ZEROS WILL BE
;SUPPRESSED.  REGISTER E IS NON ZERO IF ZEROS ARE NOT
;SUPPRESSED.  REGISTER H CONTAINS A LOW BIT WHICH
;DETERMINES WHICH DIGIT IS OUTPUTTED TO(BIT 4
;SELECTS MSD AND BIT 7 SELECTS THE LSD).
;
;INPUTS: A - 2 LSD
;        D - 2 MSD
;        CARRY - HI IF NO ZERO SUPPRESSION
;
;DESTOYS: CARRY
;
NMOT2:                      ;ENTRY POINT FOR 2 DIGIT DISPLAY
                            ;A HAS THE 2 DIGITS
        PUSH    D
        MVI     D,0         ;2 MOST SIGNIFICANT DIGITS = 0
        JMP     NMOT4+1
NMOT4:                      ;ENTRY POINT FOR 4 DIGIT DISPLAY
                            ;D HAS UPPER 2,A HAS LOWER 2
        PUSH    D
        PUSH    H
        PUSH    B
        LXI     H,0FFFFH            ;SELECT FOR MSD
        MVI     E,0
        MOV     B,A         ;SAVE 2 LSD
        JNC     DIS2D       ;JUMP IF LEADING ZEROS SUPPRESSED
        MOV     E,4         ;SHOW LEADING ZEROS
DIS2D:                      ;DISPLAY 2 DIGITS
        MOV     A,D
        RRC
```

```
        RRC
        RRC
        RRC             ;GET UPPER 4 BITS TO LOWER 4 BITS
        ANI     0FH     ;MASK OUT UPPER 4 BITS
        JNZ     ZERO2   ;IF DIGIT (LOWER 4 BITS) IS
                        ;NOT EQUAL TO ZERO, JUMP
        CMP     E
        JNZ     ZERO2+1 ;IF ALL PREVIOUS 0, BLANK
        MVI     A,0FH   ;BLANK DIGIT
        JMP     ZERO2+1 ;SKIP NEXT INSTRUCTION
ZERO2:
        MOV     E,A     ;NON ZERO DIGIT
        CALL    DISOT   ;DISPLAY OUTPUT
        MOV     A,D
        ANI     0FH     ;GET DIGIT 2
        JNZ     ZERO3   ;IF DIGIT(LOWER 4 BITS) IS
                        ;NOT EQUAL TO ZERO, JUMP
        CMP     E
        JNZ     ZERO3+1 ;IF ALL PREVIOUS 0,BLANK
        ADD     H       ;ZERO UPPER 4 BITS IF DIGIT
                        ;SELECT IS FOR LSD
        MOV     A,D     ;SET A=X0H
        JP      ZERO3+1 ;IF LSD, DISPLAY 0
        MVI     A,0FH   ;BLANK DIGIT
        JMP     ZERO3+1
ZERO3:
        MOV     E,A     ;NON ZERO DIGIT TO E
        CALL    DISOT   ;DISPLAY OUTPUT
        MOV     A,H     ;GET DIGIT SELECT
        ANA     A       ;SET FLAGS
        MOV     D,B     ;2 LSD TO D
        JPO     DIS2D   ;JUMP IF H HAS A LOW BIT
                        ;TO SELECT DIGIT
        MOV     A,B     ;RESTORE A FROM BEGINNING
                        ;VALUE
        POP     B
        POP     H
        POP     D
        RET
DISOT:                  ;DISPLAY OUTPUT
        ORI     0F0H    ;SET UPPER 4 BITS HI
        MOV     C,A
        ANA     H       ;MOVE DIGIT SELECT TO A UPPER 4 BITS
        OUT     DISPY   ;OUTPUT DIGIT
        MOV     A,C     ;RETURN DIGIT VALUE TO A
        OUT     DISPY   ;STORE DIGIT
        DAD     H       ;SHIFT DIGIT SELECT TO NEXT DIGIT
        RET
;
;ROUTINE:SMS
;
;STEPPER MOTOR SPEED
;
;THIS ROUTINE DETERMINES WHETHER THE STEPPER MOTOR IS TO
;BE RAMPING UP OR DOWN OR AT A MAXIMUM OR FIXED SPEED.
;
;DESTROYS:A,H,L,FLAGS
;
SMSPD:
        PUSH    B
        PUSH    D
        LXI     D,STPT9-1       ;STEP TABLE ADDR-1
        LXI     H,MSPDS ;MAX SPEED STATUS
        MVI     A,80H   ;A=80H
        CMP     M       ;CHECK STATUS
        INX     H       ;M=MAXIMUM SPEED
        MOV     B,M     ;B=MAXIMUM SPEED
        STC             ;SET CARRY SO THAT CONDITIONAL
                        ;RETURN WILL OCCUR IF AT MAX SPD
        JZ      SPD01   ;IF MAX SPEED, OUTPUT
        INX     H       ;M=RSTPN(RAMP STEP #)
        MOV     C,M     ;C=RSTPN
        INX     H       ;M=RAMP UP STATUS
        CMP     M       ;M=80?
        DCX     H       ;M=RAMP STEP #
```

```
        JZ      URAMP   ;JUMP IF RAMP UP STATUS=80H
DRAMP:                  ;DOWN RAMP
        MOV     A,C     ;RAMP STEP # TO A
        ADD     E       ;ADD RAMP STEP # TO BASE
                        ;ADDRESS LOCATION
        MOV     E,A     ;BASE + RSTPN RETURNED
        LDAX    D       ;NEW SPEED TO A
        DCP     C       ;DECREASE RSTPN(RAMP STEP #)
        MOV     M,C     ;SAVE RSTPN
        CMP     B       ;CHECK MAX & NEW SPEED
        JC      SPD02   ;NWSPD<MXSPD THEN JUMP
        STC             ;CARRY CAUSES CONDITIONAL RET
        JMP     SPD01
URAMP:                  ;UP RAMP
        INR     C       ;INCREASE RSTPN(RAMP STEP #)
        MOV     M,C     ;SAVE RSTPN
        MOV     A,C     ;A=RSTPN
        CMA
        MOV     C,A     ;SAVE COMPLEMENTED STEP NUMBER
        CMA
        ADD     E       ;ADD RAMP STEP # TO BASE LOCATION
        MOV     E,A     ;BASE +RSTPN RETURNED
        LDAX    D       ;NEW SPEED TO A
        CMP     B       ;CHECK MAX & NEW SPEED
        JC      SPD02   ;NWSPD<MXSPD?
MX:                     ;MAXIMUM SPEED REACHED THIS
                        ;TIME
        INX     H       ;M=URAPS(UP RAMP STATUS)
        MVI     M,0     ;CLEAR RAMP UP STATUS
        LXI     H,MSPDS ;M=MSPDS(MAX SPEED STATUS)
        MVI     M,80h   ;SET MAX SPEED STATUS
        MOV     L,C     ;SAVE RSTPN(RAMP STEP #)
SPD01:
        MOV     A,B     ;A=MXSPD(MAX SPEED)
SPD02:
        OUT     SPDGN   ;TO SPEED GENERATOR
        POP     D
        POP     B
        RC              ;RETURN IF MAX SPEED WAS NOT
                        ;REACHED THIS TIME
        LDA     NCTMS   ;NO CUT MARK STATUS
        ANA     A       ;SET FLAGS
        JM      RPDNA   ;JUMP IF NO CUT MARK STATUS
        MOV     A,L     ;COMPLEMENTED RAMP DOWN STEPS
        INR     A       ;MAKE TWO'S COMPLEMENT
        LXI     H,ACTF1 ;LOCATION OF TWO LSD OF AFTER
                        ;CUT MARK FEED
        ADD     M       ;SUBTRACT RAMP DOWN STEPS
        MOV     M,A     ;SAVE NEW FEED LENGTH
        RC              ;RETURN IF CARRY
        INX     H       ;LOCATION OF MSD OF AFTER
                        ;CUT MARK FEED
        DCR     M       ;REDUCE MSD BY ONE
        RET
RPDNA:                  ;RAMP DOWN ADJUSTMENT
        MVI     H,0FFH
        DAD     B       ;REDUCE TOTAL FEED BY RAMP
                        ;DOWN STEPS
        INX     H       ;ADJUST FOR CARRY
        MOV     B,H     ;FEED BEFORE RAMP DOWN
        MOV     C,L     ; TO BC
        RET
;
;ROUTINE:TRIM
;
;THIS ROUTINE ENERGIZES THE CUT SOLENOID FOR THE
;LENGTH OF TIME DETERMINED BY CUTL.  IF ENTRY IS
;MADE AT TRIM1 THE SOLENOID WILL BE TURNED OFF
;AFTER THE PROPER ENERGIZATION TIME.
;
TRIM:
        OUT     CTON    ;TURN CUT SOLENOID ON
        MVI     A,CUTL-3        ;CUT SOLENOID ON TIME
        CALL    DELAY
TRIM1:
```

```
        MVI     A,3         ;ENTRY POINT WHEN EARLY CUT
        CALL    DELAY
        OUT     CTOFF       ;TURN CUT SOLENOID OFF
        RET
;
;ROUTINE:DB
;
;THIS IS THE LOOK UP TABLE FOR THE SELECTED SPEED.
;THE STEP RATE IS (41.66 STEPS/SEC)(LOOK UP)
;
        ORG     SPDTB
SPDTB:  DB      1CH,20H,24H,29H,36H         ;SELECT 0-4
        DB      44H,54H,66H,81H,99H         ;SELECT 5-9
;
;THIS IS THE LOOK UP TABLE FOR THE STEPPER MOTOR RAMP.
;
;               SPEED(41.66 STEP/SEC)(LOOKUP)    STEP#
;
STPTB:  DB      16H,29H,49H,37H,44H,50H,58H      ;1-7
        DB      61H,63H,65H,68H,70H,72H,74H      ;8-14
        DB      76H,78H,79H,82H,83H,83H,84H      ;15-21
        DB      87H,87H,87H,90H,90H,91H,92H      ;22-28
        DB      92H,92H,93H,94H,94H,94H,96H      ;29-35
        DB      96H,97H,98H,98H,99H              ;36-40
;
;ROUTINE:DS
;
        ORG     DSTOR
SWSTM:  DS      1           ;STATUS OF PB & TOGGLE SWITCHES
NCTMS:  DS      1           ;BIT 7 HI,NO CUT MARK STATUS
LONFD:  DS      1           ;BIT 7 HI IF NEW PAPER ROLL
MXPRM:  DS      1           ;MAX NUMBER PRINTS THIS ORDER(BCD)
CTOTM:  DS      1           ;CUT OUT LENGTH-MEMORY(BINARY)
ACTF1:  DS      1           ;2 LSD,FEED AFTER CT MARK(BINARY)
ACTF2:  DS      1           ;MSD,FEED AFTER CUT MARK(BINARY)
MSPDS:  DS      1           ;BIT 7 HI,AT MAX SPEED
MXSPD:  DS      1           ;MAX SPEED
RSTPN:  DS      1           ;RAMP STEP #
URAPS:  DS      1           ;BIT 7 HI,RAMP UP STATUS
RRPDN:  DS      1           ;BIT 7 HI,READY TO RAMP DOWN
ACTM:   DS      1           ;BIT 7 HI,LOOKING FOR END OF PRT
CTVAL:  DS      1           ;BIT 7 HI,CUT MARK IS ACCEPTABLE
MISCM:  DS      1           ;CUT MARK YET TO MISS
PFD1:   DS      1           ;2 LSD OF FEED LAST CUT(BINARY)
PFD2:   DS      1           ;MSD OF FEED LAST CUT(BINARY)
PRCT:   DS      1           ;# OF PRINTS CUT THIS ORDER(BCD)
ORDCT:  DS      3           ;# ORDERS TOTAL(BCD)
PRCT1:  DS      3           ;# PRINTS CUT TOTAL(BCD)
CTMNW:  DS      1           ;BIT 7 HI,CUT MARK ON PRESENT
                            ;(NEW) CUT
CTMOD:  DS      1           ;BIT 7 HI,CUT MARK ON PREVIOUS
                            ;(OLD) CUT
STOPM:  DS      1           ;BIT 7 HI,STOP SELECTED SINCE
                            ;LAST CUT
MFDL:   DS      2           ;MEASURED FEED LENGTH(BCD)
MFDAC:  DS      2           ;MEASURED FEED LENGTH AFTER
                            ;CUT MARK(BCD)
PWRON:  DS      1           ;BIT 7 HI IF PRINTS HAVE BEEN CUT
                            ;SINCE POWER ON & NO ERROR IN LAST ADVANCE
TOT1?:  DS      1           ;BIT 7 HI IF FIRST TOTAL HAS
                            ;BEEN DISPLAYED
DIG4S:  DS      1           ;BIT 7 HI IF UPPER FOUR DIGITS ARE
                            ;TO BE DISPLAYED NEXT
CTELY:  DS      1           ;BIT 7 HI IF CUT SOLENOID IS TO BE
                            ;ENERGIZED EARLY WHEN RAMP DOWN BEGINS
REQCM:  DS      1           ;BIT 7 HI IF CUT MARKS REQUIRED ON ALL PRINTS
WHY:    DS      2           ;CONTAINS ADDRESS OF REASON FOR PAPER CUTTER STOP
        END
```

What is claimed is:

1. In a photographic print cutter system in which photogrpahic prints from a plurality of customer orders are cut from a strip of photographic paper, the improvement comprising:

knife means;

knife actuating means for actuating the knife means to cut a photographic print from the strip;

print count means for incrementing a print count for an order each time the knife actuating means actuates the knife means;

end-of-order means for providing an end-of-order signal indicative of the end of a customer order;

accumulator means for holding a count;

display means for displaying the count held in the accumulator means;

means for producing a packer/sorter signal indicating that an automatic print packing or sorting device is being used in conjunction with the photographic print cutter system; and first means for causing the print count then contained in the print count means to be supplied to the acculator means if either the end-of-order signal or the packer/sorter signal is present.

2. The invention of claim 1 and further comprising:

first storage means for storing a total print count and incrementing the total print count each time the knife actuating means actuates the knife means;

second storage means for storing a total order count and incrementing the total order count each time the end-of-order signal is produced;

second means for causing the total print count and total order count to be supplied to the accumulator means; and mode switch means for causing the first means to operate when in a first mode and causing the second means to operate when in a second mode.

3. The invention of claim 2 wherein the second means alternately supplies the total print count and the total order count to the accumulator means.

4. The invention of claim 1 and further comprising:

stop means for causing the print count then contained in the print count means to be supplied to the accumulator means if the photographic print cutter system is stopped before an end-of-order signal is produced.

* * * * *